US006250624B1

(12) United States Patent
Kiyohara et al.

(10) Patent No.: US 6,250,624 B1
(45) Date of Patent: Jun. 26, 2001

(54) EXTENSION GUIDE APPARATUS

(75) Inventors: Naoki Kiyohara, Tokyo; Iwao Kawamura, Kanagawa; Kiyokazu Namekata, Tokyo; Kazuhiro Murakami, Tokyo; Kazuhiro Nisimura, Tokyo; Kensuke Izuma, Tokyo; Ryoma Suzuki, Toyko; Satoru Sasame, Tokyo; Yuuichi Sugiyama, Tokyo; Tatsuo Fujimura, Tokyo, all of (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/125,940

(22) PCT Filed: Mar. 3, 1997

(86) PCT No.: PCT/JP97/00638

§ 371 Date: Aug. 28, 1998

§ 102(e) Date: Aug. 28, 1998

(87) PCT Pub. No.: WO97/32730

PCT Pub. Date: Sep. 12, 1997

(30) Foreign Application Priority Data

| | | |
|---|---|---|
| Mar. 4, 1996 | (JP) | 8-046071 |
| Jun. 28, 1996 | (JP) | 8-188208 |
| Jul. 12, 1996 | (JP) | 8-183848 |
| Jul. 25, 1996 | (JP) | 8-196659 |

(51) Int. Cl.[7] ..... B65H 3/44

(52) U.S. Cl. ..... 271/9.1; 271/264; 271/272; 271/314; 346/136; 347/8; 347/104; 400/283; 400/642; 400/313; 242/564.4; 242/615.3; 226/91; 226/196.1

(58) Field of Search ..... 226/196.1, 91; 242/564.4, 615.3, 566; 347/104, 8; 400/283, 642, 645, 319, 313, 313.3, 613.1, 647.1, 618, 619; 346/136; 271/264, 274, 272, 273, 314

(56) References Cited

U.S. PATENT DOCUMENTS

| | | | | |
|---|---|---|---|---|
| 1,755,183 | * | 4/1930 | Kurowski | 400/645 |
| 3,731,389 | * | 5/1973 | King | 33/189 |
| 4,907,348 | * | 3/1990 | Hubbard | 33/767 |
| 5,209,591 | * | 5/1993 | Mizutani et al. | 400/645 |
| 5,210,956 | * | 5/1993 | Knispel et al. | 33/761 |
| 5,222,820 | * | 6/1993 | Kamei et al. | 400/645 |
| 5,951,181 | * | 9/1999 | Hierro et al. | 400/645 |

FOREIGN PATENT DOCUMENTS

| | | | | |
|---|---|---|---|---|
| 57111556 | * | 7/1982 | (JP) | 399/200 R |

* cited by examiner

*Primary Examiner*—Christopher P. Ellis
*Assistant Examiner*—Richard Ridley
(74) *Attorney, Agent, or Firm*—Dellett and Walters

(57) ABSTRACT

An extension guide unit 30 is provided on a side portion of a recording medium conveying passage. An extension guide 36 is held in a wound state in an extension guide holder 31 of the extension guide unit 30. In order to convey a recording medium, the extension guide 36 is drawn out, by which the recording medium is guided. This enables the recording medium to be smoothly conveyed.

32 Claims, 28 Drawing Sheets

EXTENSION GUIDE APPARATUS

TECHNICAL FIELD

The present invention relates to a recording medium conveying apparatus for conveying recording mediums in an image forming apparatus in which an image is formed on a recording medium such as a recording sheet.

BACKGROUND ART

There is known, as one of output devices of computers and workstations, an image forming apparatus employing an ink-jet system in which ink is ejected to form an image on a recording medium. The image forming apparatus employing an ink-jet system comprises, for example, a print head for ejecting ink, a carriage on which the print head is mounted, said carriage reciprocating in a predetermined direction, a recording medium conveying device for conveying recording mediums in a direction intersecting perpendicularly to the predetermined direction, and a print plate disposed at a position in which the print plate is opposite to the print head reciprocating, wherein a recording medium is conveyed on one side (a surface facing the print head) of the print plate.

In recording of an image on a recording medium, the recording medium being conveyed by the recording medium conveying apparatus (device) is once stopped. A fraction of the image is formed in a long and narrow band shape by ejection of ink from a reciprocatingly moving print head in accordance with image signals on the recording medium in an image formation area. Then the recording medium is moved forward by the breadth of the formed fractional image, and is stopped to form another image fraction on an adjacent unprinted portion of the recording medium. Such operation is repeated to form the entire image on the recording medium.

As the above-mentioned recording medium conveying apparatus, there is known such a type of one having, for example, a first conveyance roller for supporting and conveying a recording medium, and a second conveyance roller for supporting and conveying the recording medium discharged from the first conveyance roller, which are disposed on the upward stream side and the downward stream side with respect to a direction of the recording medium conveyance across the print plate from one another, respectively.

In such a type of recording medium-conveying apparatus, if the sheet-shaped recording medium curls after passage through the first conveyance roller, the front end portion of the recording medium is directed upward or downward, and cannot be caught and conveyed by the second conveyance roller. Therefore, the recording medium may not be exactly conveyed, or may be hooked by surrounding parts to cause jamming of the recording medium.

An area put between the first conveyance roller and the second conveyance roller forms the image formation area for an image formation. Consequently, in order to obtain a good quality of image, there is a need to convey recording mediums in the flat state free from the above-mentioned trouble.

Usually, as a technology of conveying recording mediums in the flat state, there is known a guide plate system wherein a guide plate, which extends in a direction intersecting perpendicularly to the recording medium conveying direction, is disposed between the first conveyance roller and the second conveyance roller, and is fixed in such a manner that the inlet side of the recording medium is opened and the outlet side of the recording medium is narrowed, so that the recording medium is guided through the guide plate. As alternative technology, there are known a suction system wherein a suction fan is disposed below the print plate to convey a recording medium to the second conveyance roller while the recording medium is sucked, and an electrostatic system wherein a recording medium is conveyed while the recording medium is absorbed on an electrostatic basis.

By the way, in the image forming apparatus employing an ink-jet system, in order to obtain a good quality of image, there is a need to make the print head come close to the recording medium. For this reason, usually, there is no space around the print plate. According to the above-mentioned guide plate system, the guide plate is disposed between the first conveyance roller and the second conveyance roller, and this keeps the print head away from the first conveyance roller or the second conveyance roller. Therefore, it is hard to ensure the flatness of the portion facing the print head, of the recording medium, and thus there is a possibility such that the quality of image is degraded. In addition, this is associated with such a problem that the tip margin of the recording medium becomes large unnecessarily. Further, for the image forming apparatus employing an ink-jet system, there is a need, at the time of image formation, to cope with a cockling (a phenomenon in which a recording medium partially absorbing ink expands and whereby unevenness is formed on the expanded portion and its periphery) which will occur on the recording medium. Thus, also in this respect, the guide plate system is disadvantageous.

On the other hand, according to the suction system as mentioned above, the suction fan is disposed below the print plate. This needs the space for such an arrangement. Thus, the suction system is disadvantageous from a viewpoint of miniaturization of the apparatus and low cost of the apparatus. Further, also with respect to the electrostatic system, in a similar fashion to that of the suction system, it is disadvantageous in miniaturization of the apparatus and low cost of the apparatus.

DISCLOSURE OF THE INVENTION

In view of the foregoing, it is an object of the present invention is to provide a recording medium conveying apparatus capable of not only smoothly conveying recording mediums, but also obtaining a high quality of image.

The present invention has been made to attain the above-mentioned object and is to provide a first recording medium conveying apparatus for an image forming apparatus having a first conveyance roller for conveying a recording medium, and a second conveyance roller for conveying the recording medium discharged from the first conveyance roller, in which an image is formed on the recording medium between the first conveyance roller and the second conveyance roller, said recording medium conveying apparatus comprising:

(1) an extension guide for guiding the recording medium conveyed by the first conveyance roller, said extension guide being retractively extendable from a side of a recording medium conveying passage in an intersection direction intersecting a recording medium conveying direction between the first conveyance roller and the second conveyance roller; and (2) an extension guide holder for holding said extension guide, said extension guide holder being disposed at the side of the recording medium conveying passage.

In the recording medium conveying apparatus as mentioned above, it is acceptable that the apparatus further comprises (3) a scanning member for scanning in the intersection direction between the first conveyance roller and the second conveyance roller in the intersection direction, and (4) said extension guide is coupled with said scanning member and is retractively extendable in the intersection direction following scanning of said scanning member.

In the recording medium conveying apparatus as mentioned above, (5) it is acceptable that said apparatus further comprises a coupling unit for coupling said extension guide with said scanning member.

Further, in the recording medium conveying apparatus as mentioned above, (6) it is acceptable that said extension guide is replaced by an extension sheet clamp for clamping the recording medium discharged from the first conveyance roller, said extension sheet clamp being refractively extendable from the side of the recording medium conveying passage in the intersection direction between the first conveyance roller and the second conveyance roller, and (7) said extension guide holder holds said extension sheet clamp.

Furthermore, in the recording medium conveying apparatus as mentioned above, (8) it is acceptable that said apparatus further comprises a holding unit for holding said extension sheet clamp extended, said holding unit being disposed at a side of the recording medium conveying passage, said side being opposite to the side in which said extension guide holder is disposed.

To attain the above-mentioned object, there is provided a second recording medium conveying apparatus for an image forming apparatus having a first conveyance roller for conveying a recording medium, and a second conveyance roller for conveying the recording medium discharged from the first conveyance roller, in which an image is formed on the recording medium between the first conveyance roller and the second conveyance roller, said recording medium conveying apparatus comprising:

(9) extension guide means for providing a temporal conveyance guide for a recording medium by extending a strip-shaped extension guide which is retractively extendable from a side of a recording medium conveying passage in a direction perpendicularly intersecting a recording medium conveying direction between the first conveyance roller and the second conveyance roller;

(10) recording medium type selection means for selecting a type of the recording medium to be used; and

(11) extension guide control means for controlling a timing of utilization of said extension guide in accordance with the type of the recording medium selected by said recording medium type selection means.

In the recording medium conveying apparatus as mentioned above,

(12) it is acceptable that the type of the recording medium is a rolled paper and a cut sheet.

Further, in the recording medium conveying apparatus as mentioned above,

(13) it is acceptable that said extension guide control means provides such a control that in the event that the type of the recording medium is the cut sheet, an extension of said extension guide is performed before a tip of the cut sheet is discharged from the first conveyance roller, and in the event that the type of the recording medium is the rolled paper, an extension of said extension guide is performed after the rolled paper is cut off at a position through which the rolled paper passes, and a tip of a new rolled paper returns to passing through the second conveyance roller and again enters the second conveyance roller, and thereafter in any cases said extension guide goes back before an image formation.

Furthermore, in the recording medium conveying apparatus as mentioned above,

(14) it is acceptable that said apparatus further comprises extension suppression means for suppressing an extension action of said extension guide.

Still further, in the recording medium conveying apparatus as mentioned above,

(15) it is acceptable that said extension suppression means suppresses an extension action of said extension guide in accordance with an instruction of a user.

Still further, in the recording medium conveying apparatus as mentioned above, it is acceptable that said extension suppression means comprises:

(16) roll paper residual quantity detection means for detecting that a residual quantity of rolled paper is less than a predetermined quantity; and

(17) means for suppressing an extension of said extension guide until said roll paper residual quantity detection means detects that a residual quantity of rolled paper is less than the predetermined quantity.

To attain the above-mentioned object, there is provided a third recording medium conveying apparatus for an image forming apparatus having a first conveyance roller for conveying a rolled paper as a recording medium, and a second conveyance roller for conveying the recording medium discharged from the first conveyance roller, in which an image is formed on the recording medium between the first conveyance roller and the second conveyance roller, said recording medium conveying apparatus comprising:

(18) extension guide means for providing a temporal conveyance guide for a recording medium by extending a strip-shaped extension guide which is retractively extendable from a side of a recording medium conveying passage in a direction perpendicularly intersecting a recording medium conveying direction between the first conveyance roller and the second conveyance roller; and

(19) extension guide control means for providing such a control that an extension of said extension guide is performed after the rolled paper is cut off at a position through which the rolled paper passes, and a tip of a new rolled paper returns to passing through the second conveyance roller and again enters the second conveyance roller, and said extension guide goes back before an image formation.

In the recording medium conveying apparatus as mentioned above,

(20) it is acceptable that said apparatus further comprises extension suppression means for suppressing an extension action of said extension guide.

Further, in the recording medium conveying apparatus as mentioned above,

(21) it is acceptable that said extension suppression means suppresses an extension action of said extension guide in accordance with an instruction of a user.

Furthermore, in the recording medium conveying apparatus as mentioned above, it is acceptable that said extension suppression means comprises:

(22) roll paper residual quantity detection means for detecting that a residual quantity of rolled paper is less than a predetermined quantity; and

(23) means for suppressing an extension of said extension guide until said roll paper residual quantity detection means detects that a residual quantity of rolled paper is less than the predetermined quantity.

To attain the above-mentioned object, there is provided a fourth recording medium conveying apparatus in an image forming apparatus having a print plate on a one side of which a recording medium is conveyed, said print plate being extended in an intersection direction intersecting a recording medium conveying direction, wherein an image is formed on a portion located at said one side of said print plate, of the recording medium, the recording medium conveying apparatus having a first conveyance roller for supporting and conveying the recording medium in the recording medium conveying direction, and a second conveyance roller for supporting and conveying the recording medium discharged from the first conveyance roller, said first conveyance roller and said second conveyance roller being disposed at an upward stream side and a downward stream side with respect to the recording medium conveying direction across said print plate from one another, respectively, said recording medium conveying apparatus comprising:

(24) a scanning member for scanning an opposite side to said print plate across the portion located at said one side of said print plate, of the recording medium, in the intersection direction;

(25) a strip-shaped extension guide inclined by a predetermined angle in such a manner that an interval between the upward stream side portion with respect to the recording medium conveyance direction and the print plate is broader than an interval between the downward stream side portion with respect to the recording medium conveyance direction and the print plate, said extension guide being detachably coupled with said scanning member and being retractive in the intersection direction on said opposite side; and

(26) an extension guide holder having an inlet and outlet for said extension guide, said extension guide holder being adapted to hold said extension guide in a wound state on a freedom basis in taking in and out, and being disposed at a one side of said print plate in its longitudinal direction.

In the recording medium conveying apparatus as mentioned above,

(27) it is acceptable that incline means for inclining said extension guide by a predetermined angle is provided on at least one of a coupling portion of said scanning member with said extension guide and a neighbor portion of the inlet and outlet of said extension guide holder.

Further, in the recording medium conveying apparatus as mentioned above,

(28) it is acceptable that said incline means releases incline of the predetermined angle of said extension guide after the recording medium is supported by at least one of said first conveyance roller and said second conveyance roller.

Furthermore, in the recording medium conveying apparatus as mentioned above, it is acceptable that said extension guide holder comprises:

(29) a holder container having a predetermined inlet and outlet formed on a side wall, and a center shaft extending from a center of a bottom wall in a height direction;

(30) a plate spring, a one end of which is fixed on said center shaft, wound around said center shaft;

(31) a ring member surrounding a periphery of said plate spring, another end of said plate spring being fixed on said ring member;

(32) an extension member, a one end of which is fixed on said ring member, wound around said ring member and another end of which is drawn out through said predetermined inlet and outlet to be extended; and

(33) an auxiliary spring, a one end of which is fixed on said center shaft, for pressing a roughly wound portion of said plate spring by another end of the auxiliary spring from inside of said plate spring.

Still further, in the recording medium conveying apparatus as mentioned above,

(34) it is acceptable that the center shaft of said holder container enables a fixing position for fixing said one end of said auxiliary spring to alter, and

(35) said auxiliary spring alters a pressing position for pressing said plate spring in accordance with an alteration of the fixing position.

Still further, in the recording medium conveying apparatus as mentioned above,

(36) it is acceptable that a plurality of said auxiliary springs are fixed on the center shaft and pressing positions for pressing said plate spring are mutually differentiated.

BEST MODE FOR CARRYING OUT THE INVENTION

Figure 1:
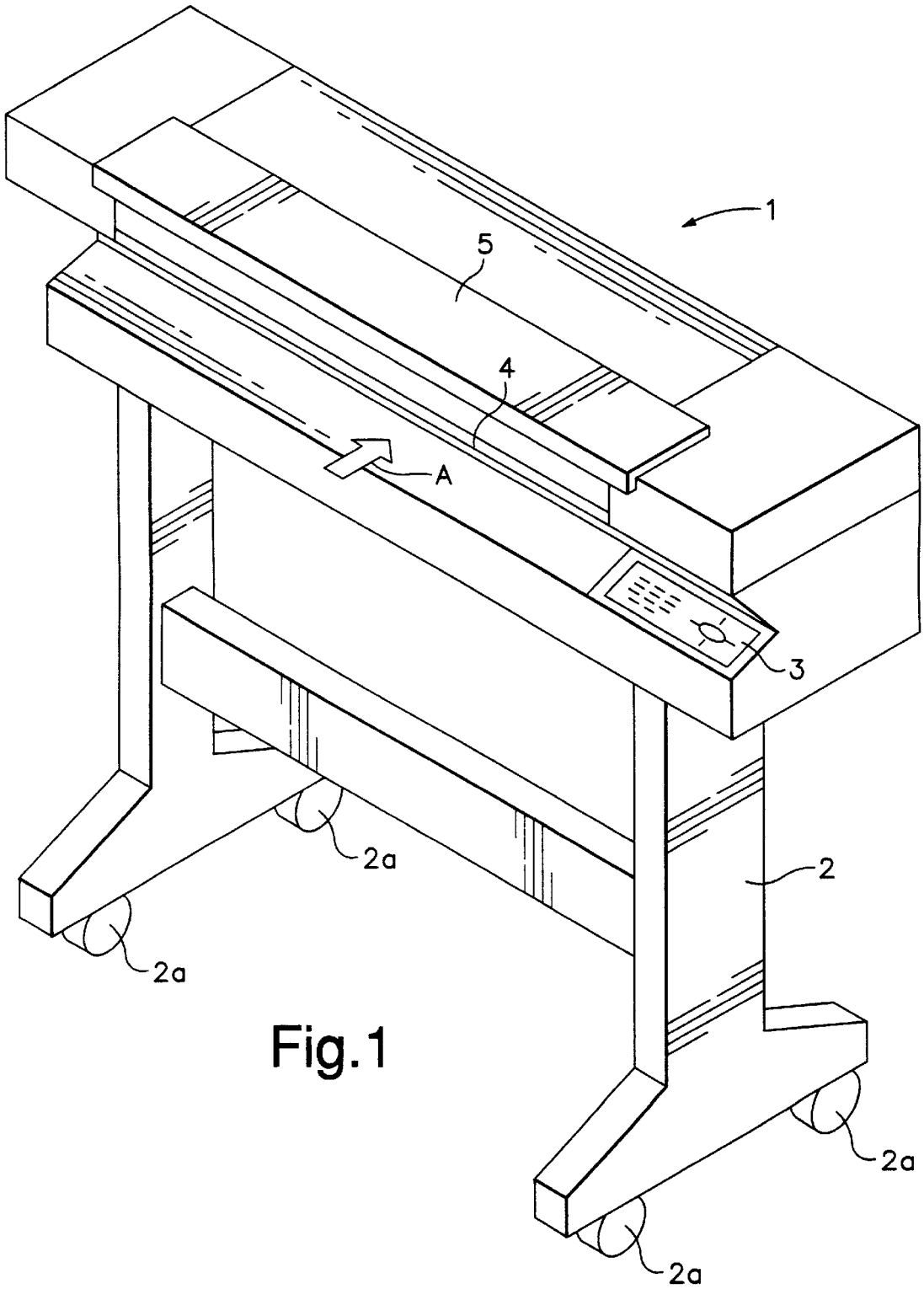
FIG. 1 is a perspective view showing a schematic construction of a plotter in which a recording medium conveying apparatus according to the present invention is used.

Hereinafter, embodiments of a recording medium conveying apparatus of the present invention will be described with reference to the drawing.

First, with reference to FIG. 1, there will be explained a schematic construction of a color plotter (hereinafter, it will be referred to as a plotter) employing an ink-jet system in which a recording medium conveying apparatus of the present invention is used. It is noted that the recording medium conveying apparatus of the present invention is not restricted in application to an image forming apparatus employing an ink-jet system or to the plotter. The recording medium conveying apparatus of the present invention is applicable to, for example, a heat-sensitive process type of image forming apparatus and a heat transfer type of image forming apparatus.

A plotter 1 is fixed on the top of a stand 2 equipped with casters 2*a*. The plotter 1 has a final control element 3 for operating the plotter 1. Operating various types of switches and the like provided on the final control element 3 permits instructions for a paper size, on-line/off-line, a command, an extension suppression which will be described later,etc. A recording sheet, which is inserted into a recording medium insertion inlet 4 from an arrow A direction, is conveyed into the inside of the plotter 1 in accordance with an instruction inputted through the final control element 3, and is discharged after printing for an image. The plotter 1 has also a cover 5 for covering the inside of the plotter 1.

Next, there will be described a conveyance path for recording sheets and a print (image forming) process with reference to FIG. 2.

The plotter 1 may perform a printing selectively either on a sheet-like shaped recording paper (for example, a large-sized cut sheet) inserted from the recording medium insertion inlet 4 and a recording paper (a rolled paper) 6 wound as a roll. Here, there will be described a conveyance passage for cut sheets inserted from the recording medium insertion inlet 4. Also with respect to the rolled paper 6, the conveyance passage is similar to the matter as to the cut sheet, but different in the insertion inlet.

For example, a large-sized cut sheet is regularly placed on a cover 7 for the rolled paper 6 and is inserted into the recording medium insertion inlet 4 from an arrow A direction. The cut sheet thus inserted passes between the cover 7 and an upper guide 8, and reaches the upper portion of a print plate 13, while being supported by both a sheet conveyance roller 10*a* rotatably fixed on a lower conveyance roller supporting plate 9 and a sheet conveyance roller 10*b*, and a drive roller 12. The cut sheet, which has passed through the upper portion of the print plate 13, is discharged while being supported by a discharge roller 14 and spurs 15 which are located above the discharge roller 14. The spurs 15 are rotatably fixed on a spur plate 16. Here, the sheet conveyance roller 10*b* and the drive roller 12 constitute an example of the first conveyance roller referred to as the present invention. And the discharge roller 14 and the spurs 15 constitute an example of the second conveyance roller referred to in the present invention.

The plotter 1 has a carriage (an example of the scanning member referred to in the present invention) 17 which reciprocates in an arrow B direction. The carriage 17 has a head holder 18 on which four print heads 19 accommodating four types of color inks (for example, cyan, magenta, yellow and black), respectively, are mounted. The carriage 17 is fixed on a belt 20 which is coupled with a driving motor (not illustrated). The belt 20 reciprocates in an arrow B direction in accordance with a forward-backward rotation of the driving motor. Reciprocation of the belt 20 in the arrow B direction causes the carriage 17 to reciprocate in the arrow B direction in accordance with a guide rail 21 which is provided behind the carriage 17. There is disposed an extension guide unit 30 (which will be described later) at the one end of the print plate 13 in the longitudinal direction.

A cut sheet is intermittently conveyed in a direction (an example of a conveyance direction) perpendicularly intersecting to the arrow B direction. When an image is formed on the cut sheet, the cut sheet is temporarily stopped, and while the carriage 17 reciprocates in the arrow B direction, ink is ejected in accordance with image information applied to the print heads 19 to form a band of image on a portion, of the cut sheet, which portion is located at an image forming area. Thereafter, the cut sheet is conveyed by a predetermined length so that a subsequent band of image is formed on a new portion of the cut sheet, which is located at the image forming area. This operation is repeated throughout the overall length of the cut sheet by a necessary number of times. Thus, a color image is formed on the cut sheet. The cut sheet on which the color image is formed is discharged along a discharge guide 22 while being supported by the discharge roller 14 and the spurs 15.

Next, there will be described an extension guide unit with reference to FIG. 3, FIG. 4 and FIG. 5.

Figure 4:
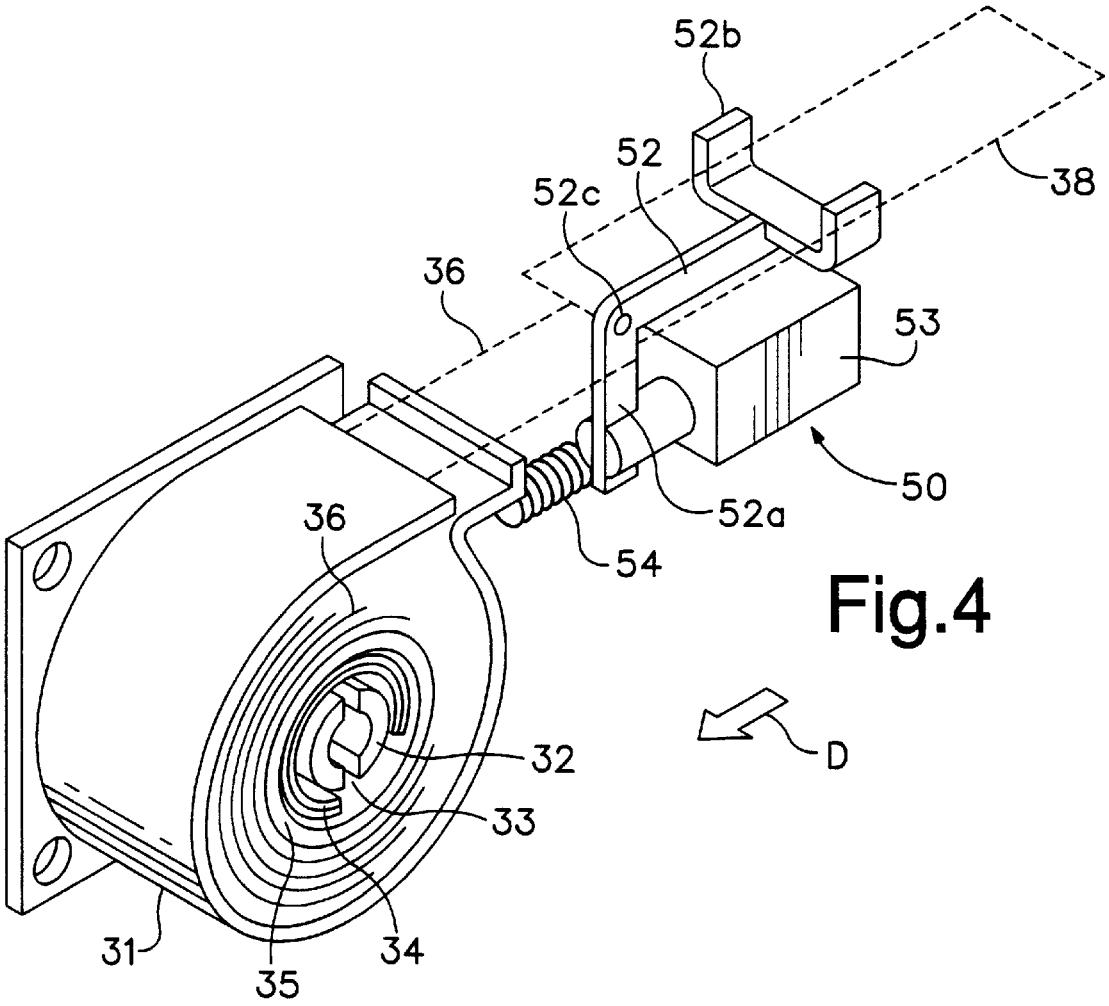
FIG. 4 is an explanatory view of details of the extension guide of FIG. 3.

An extension guide unit 30 has an extension guide holder (a case) 31 as shown in FIG. 4. In the inside of the extension guide unit 30, there is formed a center shaft 32 having a slot 33 on which one end of a plate spring 34 is fixed. The plate spring 34 is wounded in a clockwise direction on a paper surface of FIG. 4. Another end of the plate spring 34 is fixed on a drum 35 which is rotatably mounted on the case 31. The drum 35 resists with a spring force of the plate spring 34 a turning force in the clockwise direction applied from the exterior. When the external torque exceeds the spring force of the plate spring 34, the drum 35 rotates in the clockwise direction. On the other hand, when the external torque is decreased, the drum 35 reversely rotates in the counterclockwise direction by the spring force and returns to the home position.

Figure 3:
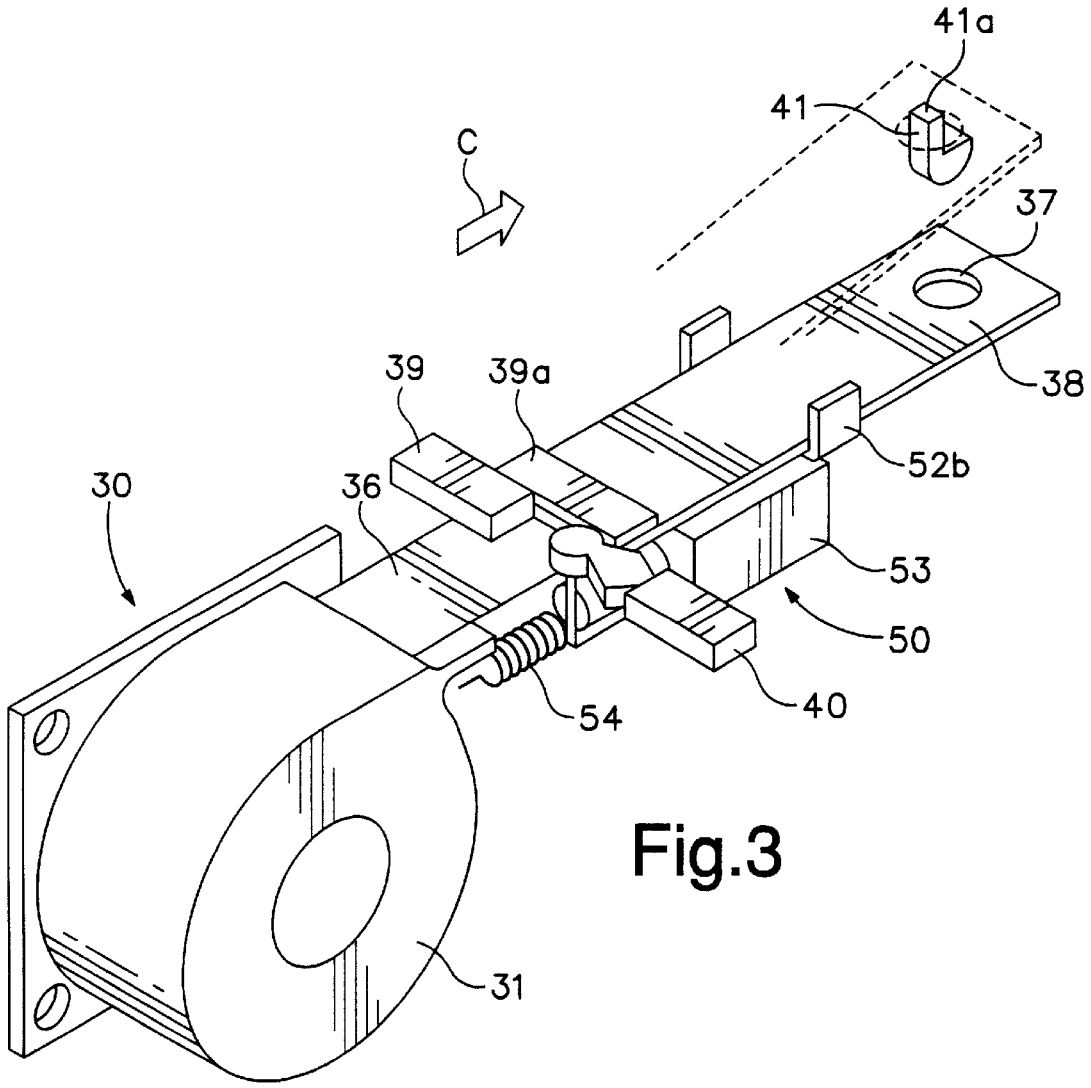
FIG. 3 is a perspective view of an extension guide employed in the recording medium conveying apparatus by way of example.

One end of a strip-like configuration of extension guide 36 in the state wounded clockwise similar to the plate spring 34 is fixed on the drum 35, and another end of the extension guide 36 is fixed on a belt plate 38 provided with a hook aperture 37, as show in FIG. 3. In other words, the belt plate 38 is fixed on the tip of the extension guide 36.

When the belt plate 38 is drawn in an arrow C direction, the strip-like configuration of extension guide 36 fixed on the belt plate 38 against the enabling force of the plate spring 34 is drawn out from the case 31, so that the extension guide 36 is extended in a direction perpendicularly intersecting the conveyance direction of a recording medium. Providing that the belt plate 38 is released from the position associated with the extension, the extension guide 36 is drawn into the case 31 of the extension guide unit 30 and is held therein.

As the extension guide 36, a flexible strip thin plate, for example, a metallic thin plate, resinous types of thin plate in strip-like configuration, etc. may be used. As materials of the extension guide 36, it is preferable to have such properties that when the extension guide 36 is held in the case 31, the extension guide 36 can be held in a wounded state and closely wounded as much as possible, and when the extension guide 36 is extended from the case 31, the linearity and the flatness can be ensured. In addition, it is preferable to select materials free from rolling peculiarities when extended.

The extension guide 36 is held in the case 31, usually, by an effect of the plate spring 34. An engagement member 39*a* is fixed on an end opposite to the hook aperture, of the belt plate 38. The engagement member 39*a* is in contact with a stopper 39(cf. FIG. 3), which is fixed in the vicinity of the entrance of the case 31, in the state that the extension guide 36 is constricted. Consequently, the belt plate 38 may stop before the entrance of the case 31. At the same time as this stop, a system (MPU which will be described later) confirms it by a sensor 40 (for example, a microswitch, etc.) that the extension guide 36 is held in the case 31 in its initial place. Conversely, it may be confirmed by the sensor 40 that the extension guide 36 is in the state that it is extended.

Next, it will be explained how the extension guide 36 functions as a conveyance guide for recording mediums.

According to the present embodiment, the carriage 17 (cf. FIG. 2) runs to the vicinity of the setting position of the case 31, or the home position of the extension guide 36, so that a hook 41 formed below the carriage 17 is inserted into the hook aperture 37. This enables the carriage 17 to be coupled with the extension guide 36, and thus as the carriage 17 moves, the extension guide 36 is extended. The upper portion 41*a* of the hook 41 is fixed on the bottom of the carriage 17 and is extended downward. A specific way of hanging the hook 41 on the hook aperture 37wi1l be described later. In this manner, according to the present embodiment, the carriage 17 serves as moving means for the extension guide 36. Accordingly, there is no need to provide additional independent moving means.

Figure 2:
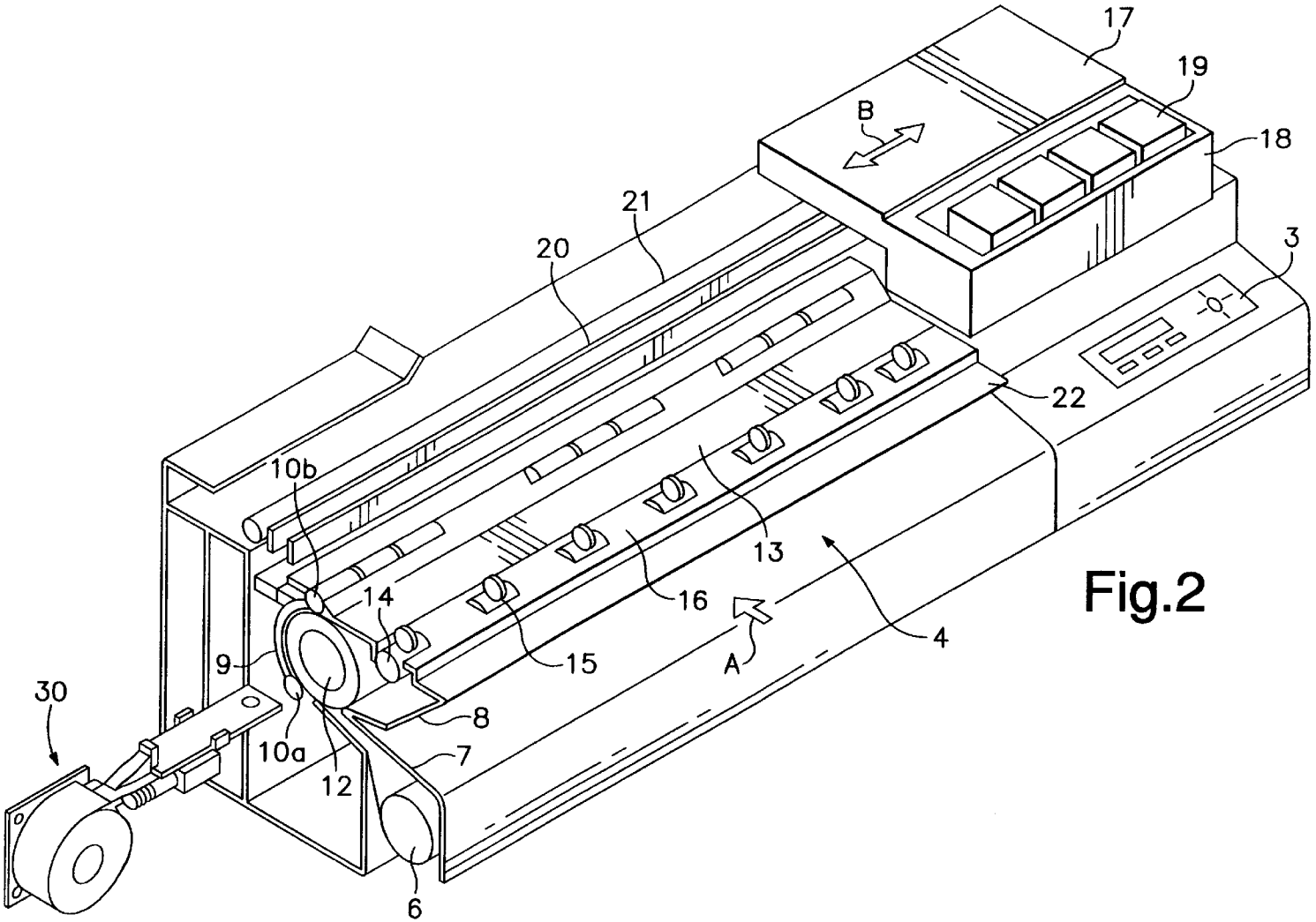
FIG. 2 is a perspective view of a path from an insertion of a recording sheet to a discharge of the recording sheet in the plotter shown in FIG. 1.
Figure 5:
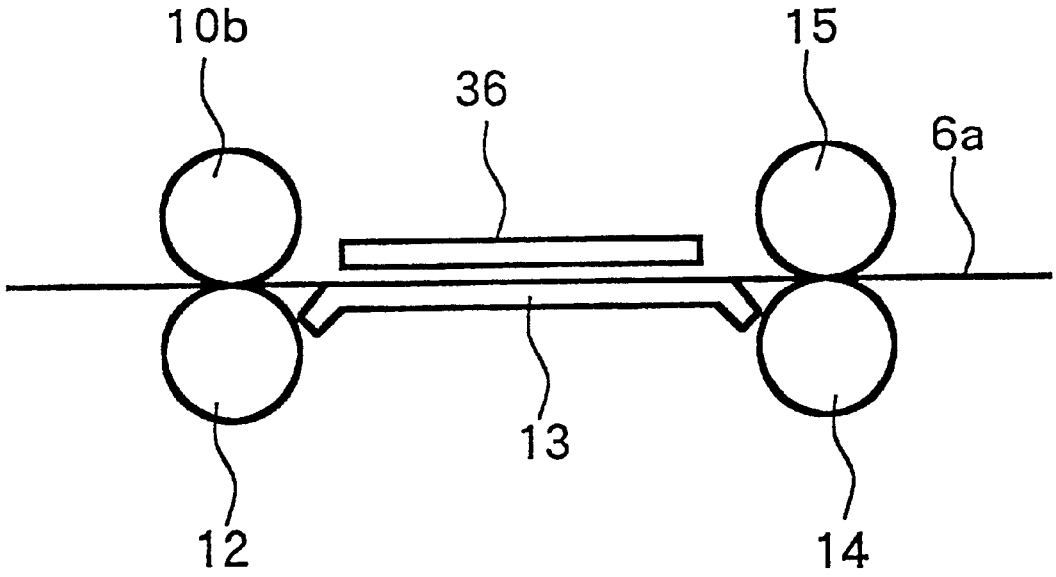
FIG. 5 is a typical illustration of the extension guide extended in the space between a first conveyance roller and a second conveyance roller.

As typically shown in FIG. 5, as the carriage 17 moves, the extension guide 36 is extended in the space between a pair of the drive roller 12 and the sheet conveyance roller 10*b* (a first conveyance roller), and a pair of the discharge roller 14 and the spur 15 (a second conveyance roller), which are also shown in FIG. 2. In this condition, the recording medium 6*a* is conveyed from the first conveyance roller through an aperture formed between the extended extension guide 36 and the print plate 13 to the second conveyance roller, so that the tip of the recording medium 6*a* enters the second conveyance roller. The recording medium 6*a* is conveyed by the extension guide 36, making sure of a flatness between the first conveyance roller and the second conveyance roller. This makes it possible to convey the recording medium 6*a* without bringing about matters such that the tip of the recording medium 6*a* is turned up, or the portion subsequent to the tip is expanded. When there is provided such a state that the recording medium 6*a* is supported by both the first conveyance roller and the second conveyance roller, it is possible to perform a printing on the recording medium 6*a*. Next, while the hook 41 of the carriage 17 and the hook aperture 37 of the belt plate 38 are engaged with one another, the carriage 17 is driven to run in the reverse direction to the extension operation, that is, the holding direction so as to be translated to the home position of the extension guide 36.

At the same time when the belt plate 38 stops by the stopper 39, the belt plate 38 goes down by its own weight, so that the engagement of the hook aperture 37 with the hook 41 is released. In this condition, it is possible to perform a printing on the recording medium 6*a* supported by the first conveyance roller and the second conveyance roller.

According to the present embodiment, while the extension guide for guiding the tip of the recording medium to the second conveyance roller is returned to the home position, it is possible to reduce the printing time if not returned.

Next, there will be described a way of engaging the hook aperture 37 with the hook 41. When a printing is performed on a recording medium, it is not preferable that the carriage 17 is in contact with the associated parts (the belt plate 38, etc.) of the extension guide 36. Consequently, there is a need to provide a certain distance in the vertical direction between the hook aperture 37 with the hook 41. In addition, if necessary, there is provided an engagement auxiliary mechanism 50 (an example of the coupling unit referred to in the present invention) for surely engaging the hook aperture 37 with the hook 41.

According to the present embodiment, the engagement auxiliary mechanism 50 or an extension guide elevating mechanism is provided below the belt plate 38 located at the home position. A solenoid 53 is mounted on a lower portion 52*a* of an L-shaped extension guide elevating lever 52 (cf. FIG. 4) which is rotatably supported by the main frame (not illustrated). The solenoid 53 is enabled by a spring 54 in an arrow D direction. On the other hand, on the upper portion of the extension guide elevating lever 52, there is provided a belt plate receiver 52*b* for receiving the belt plate 38.

When the hook 41 is engaged with the hook aperture 37, the solenoid 53 is operated in a direction opposite to the arrow D direction in accordance with an input of a specific signal. In response to the operation of the solenoid 53, the extension guide elevating lever 52 pivots counterclockwise on an L-shaped bend 52*c*, so that the belt plate receiver 52*b* of the extension guide elevating lever 52 is translated upward to raise the belt plate 38. In this manner, a free edge of the hook 41 of the carriage 17 waiting above the belt plate 38 is inserted into the hook aperture 37. In this state, when the carriage 17 moves in a direction to go away from the case 31, an elbow-shaped bend edge of the hook 41 is engaged with the hook aperture 37, and when the carriage 17 further moves, the extension guide 36 can be expanded. Thereafter, the solenoid 53 returns, so that the extension guide elevating lever 52 is released in its elevation.

Figure 6:
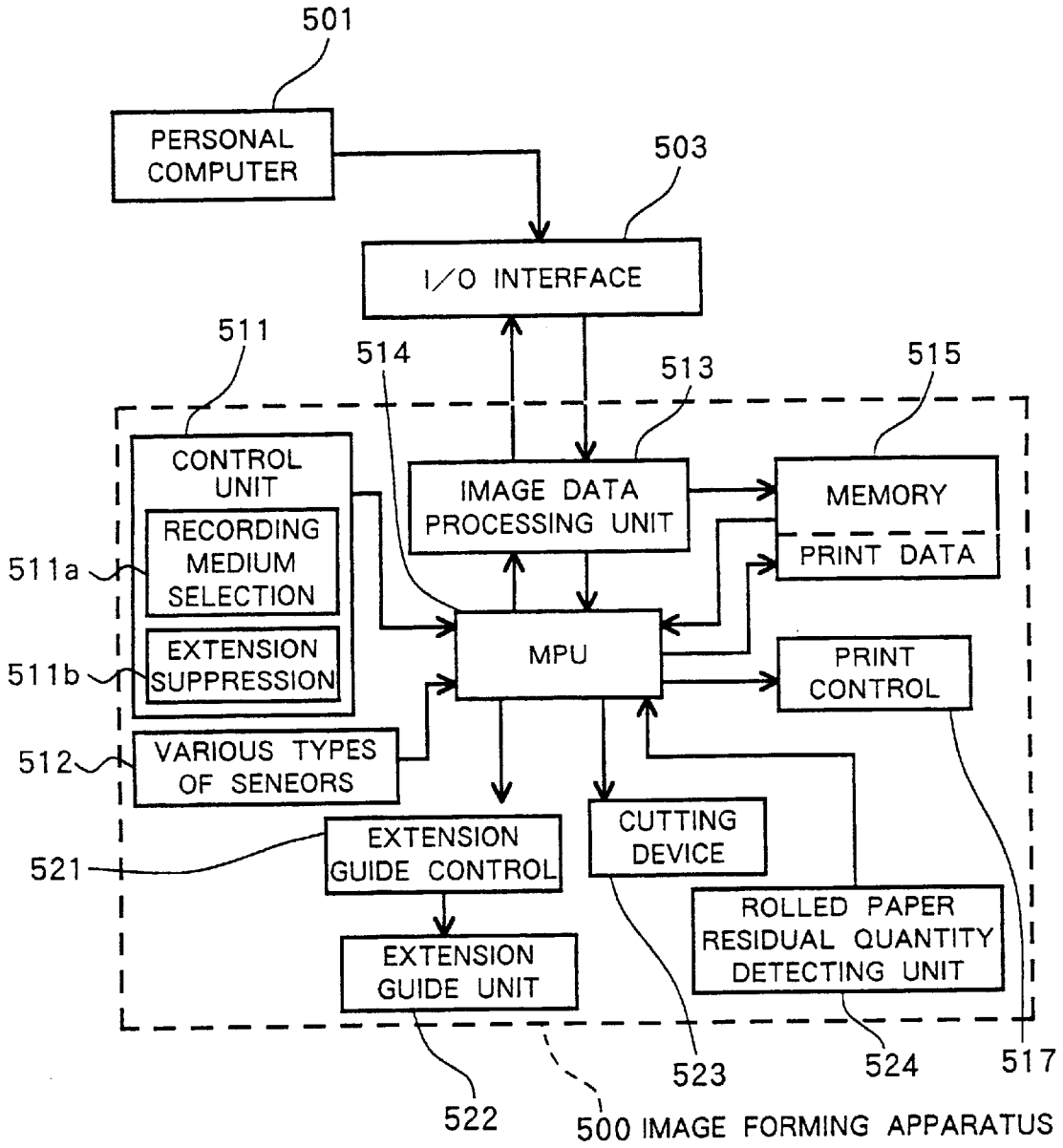
FIG. 6 is a block diagram related to a control of the image forming apparatus of FIG. 1.

Next, there will be explained a control of an image forming apparatus according to the present invention with reference to FIG. 6.

An image forming apparatus 500 comprises: a control unit 511 (corresponding to the element 3 in FIG. 1) for receiving instructions from users; various types of sensors 512 for detecting width (right and left edges) of a recording medium, leading and trailing edges of the recording medium, etc.; and an image data processing unit 513 for processing image data received from an external image information source such as a personal computer 501 via an input and output interface 503.

The image forming apparatus 500 further comprises: a memory 515 for providing storage areas for storing print data obtained in the image data processing unit 513, storage areas for storing programs for an operation of a microprocessor (which will be described later), work data areas, etc.; a print control unit 517 for performing a print control in accordance with print data; a cutting device 523 for cutting a rolled paper; an extension guide unit 522 (corresponding to the element 30 in FIG. 3); an extension guide control unit 521 for controlling the extension guide unit 522; a rolled paper residual quantity detecting unit 524 for detecting a residual quantity of rolled paper; and a microprocessor (MPU) 514 for controlling those elements. The control unit 511 has a recording medium selection button 511*a* for performing an optional selection between a rolled paper and a cut sheet, and an extension suppression button 511*b* for suppressing the function of the extension guide, in addition to the usual various types of buttons (not illustrated). Of course, it is possible to perform those control operations on an on-line basis through the external access.

By the way, it has been known by experience that there is a difference in behavior of sheets at the time of conveyance between the use of a rolled paper and the use of a cut sheet as recording mediums. With respect to a rolled paper, the smaller in winding diameter, it is easier to bring about a curl due to winding peculiarities. Regarding cut sheets, there are both types of sheets depending upon quality of sheets, sheet thickness, etc., one of which is easy to curl, another is hard to curl.

On the other hand, expansion and contraction of the extension guide needs an additional mechanical processing step, and has an effect on a print processing time. For these reasons, in the event that no problem arises in conveyance of recording mediums, it is preferable that the extension guide is not used. In view of the foregoing, according to the recording medium conveying apparatus of the present embodiment, it is permitted to use a suitable extension guide in compliance with types of recording mediums to be used.

Next, with reference to FIG. 7, there will be explained a main process for a series of image forming operation of an image forming apparatus according to the present embodiment. This main process is executed on the basis of the control of the MPU 514 in accordance with the control program stored in the memory 515.

Prior to explanation of the process in FIG. 7, with reference to FIG. 11 there will be explained various positions associated with the first and second conveyance rollers of the image forming apparatus.

As mentioned above, the first conveyance roller corresponds to the pair of the sheet conveyance roller 1Ob and the drive roller 12. A position immediately before their contact (the right side in FIG. 11) is defined as a position A. The second conveyance roller corresponds to the pair of the discharge roller 14 and the spur 15. A position immediately after their contact (the left side in FIG. 11) is defined as a position B. The print plate 13 for supporting the lower face of the recording medium is disposed between the first conveyance roller and the second conveyance roller. A position located above the print plate 13 and near the second conveyance roller is defined as a position C. A medium sensor 24 for detecting the leading edge of the recording medium is disposed at the same position as the contact of the discharge roller 14 with the spur 15 taking a side view of the apparatus.

At a cut position 26 at the outlet of the second conveyance roller (the, left side in FIG. 11), the recording medium is cut in a direction perpendicular to the conveyance direction of the recording medium by a cutter (not shown in the drawing) provided above the cut position 26.

Figure 7:
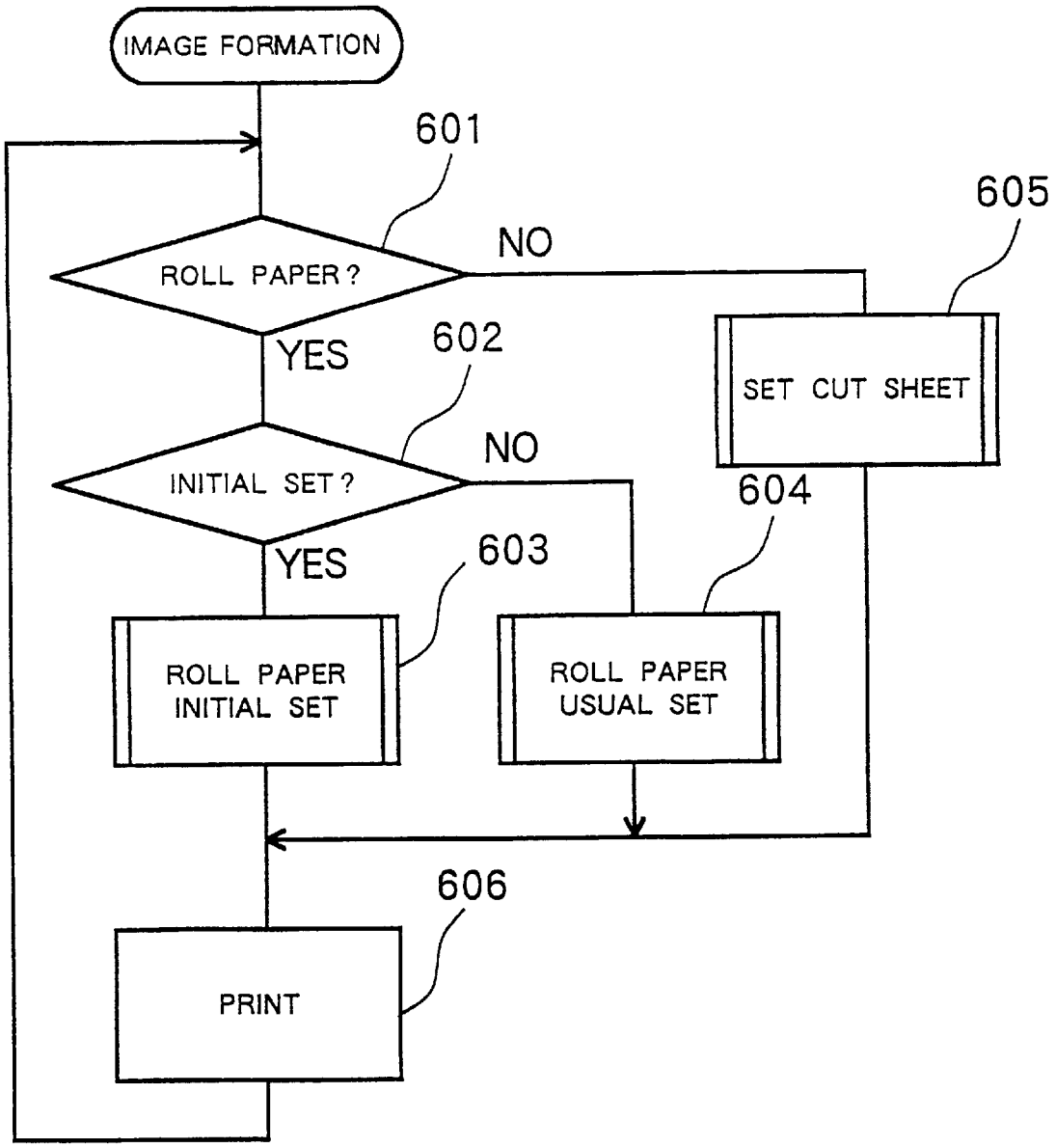
FIG. 7 is a flowchart for a main processing related to a recording medium conveyance and printing in the image forming apparatus of FIG. 1.

In the flowchart of FIG. 7, first, it is determined whether the recording medium used for an image formation is a rolled paper (601). A recording medium classification, which is designated by the recording medium selection button 511*a* of the control unit 511 (or on an on-line basis), has been stored in the memory 515 in the form of parameter beforehand. The determination in step 601 is performed on the basis of this storage information.

In the event that the recording medium to be used is a rolled paper, it is determined as to whether an initial set of the rolled paper is concerned (602). The initial set of the rolled paper implies that a new rolled paper is mounted onto an image forming apparatus so that an image formation can start. The initial set of the rolled paper can be identified by a system through detecting the leading edge of the new rolled paper by a roll medium sensor (not illustrated) located at a roll paper feed inlet from the state of the roll paper absence in the event that a rolled paper is selected by the recording medium selection button 511*a* and the like.

In the event that in the step 602, it is determined that the initial set of the rolled paper is concerned, a roll paper initial set operation (which will be described later) is performed (603). On the other hand, in the event that it is determined that the initial set of the rolled paper is not concerned, the usual set operation for the rolled paper is performed (604). Also in this respect, it will be described in detail later.

In the step 601, in the event that it is decided that the recording medium to be used is not a rolled paper, in other words, that is a cut sheet, a cut sheet set operation is performed (605). Also in this respect, it will be described in detail later.

In this manner, the set operation for the rolled paper or the cut sheet is completed. Thereafter, a print process can start in accordance with a predetermined instruction (606). After completion of formation of a sheet of image, the process returns to the first step 601 to perform a set operation for a new recording medium for the successive printing.

Figure 8:
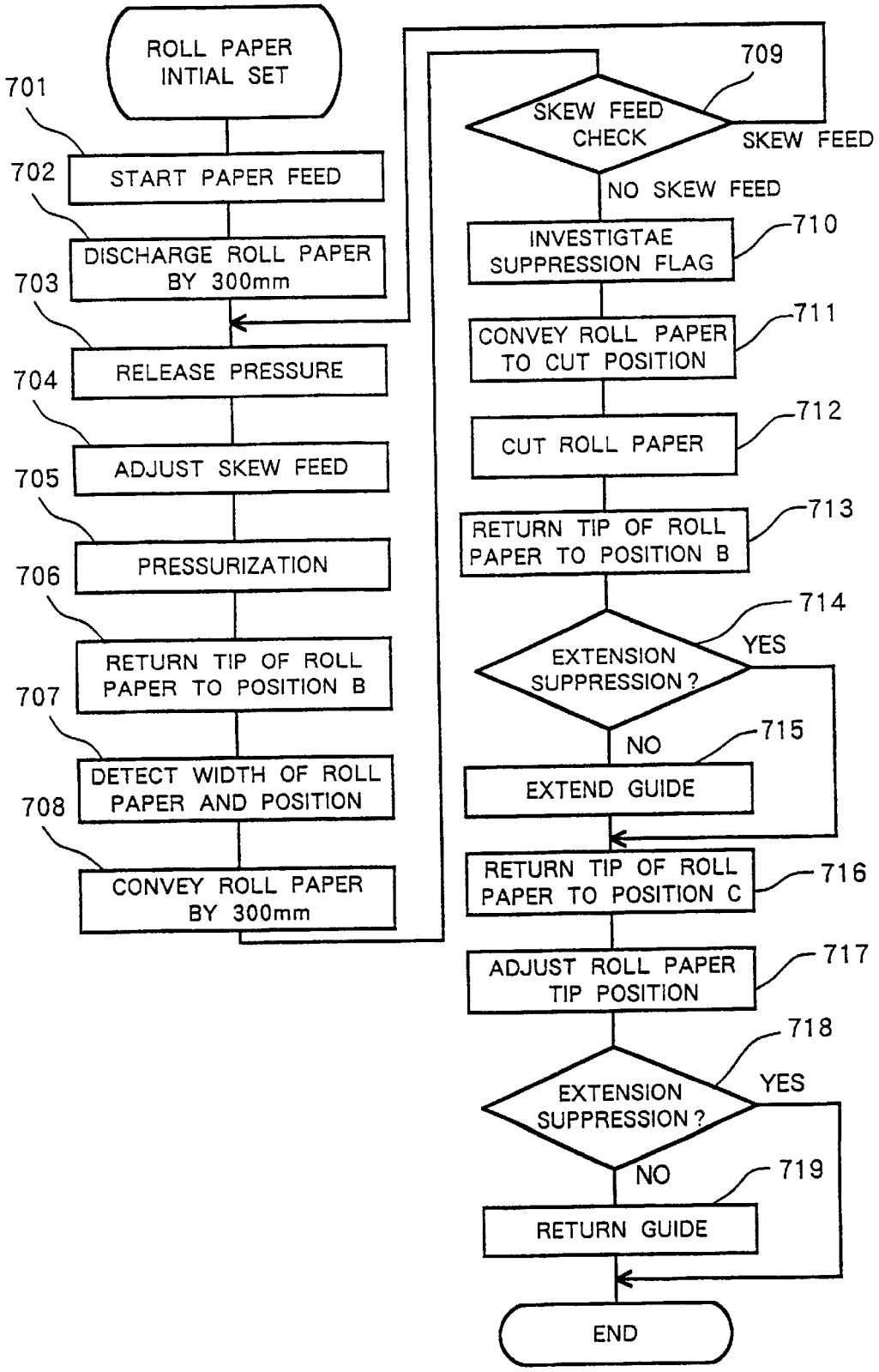
FIG. 8 is a flowchart for a processing of a rolled sheet initial setting operation of FIG. 7 by way of example.

Next, with reference to FIG. 8, there will be described the detailed process flow for the roll paper initial set explained referring to FIG. 7.

First, a user loads a new rolled paper onto the apparatus to insert the leading edge of the rolled paper into the first conveyance roller. At that time, it is assumed that the rolled paper is selected as the recording medium to be used by the recording medium selection button 511*a* and the like. When the user inserts the leading edge of the rolled paper into the first conveyance roller, the roll medium sensor detects it and a paper feed starts (701). A system feeds the rolled paper until the leading edge of the rolled paper is discharged out of the apparatus by about 300 mm (702). In this point, the pressure of the conveyance roller is released (703) to give the user an opportunity to adjust a skew feed for the rolled paper (704). This enables the user to check the presence of the skew feed in view of the discharged rolled paper. If adjustment of the skew feed is necessary, it is practiced and then pressurization is conducted again (705). The release of pressure and the pressurization can be conducted by the user through an operation of a well known pressurization lever (not illustrated).

Thereafter, the system causes the first conveyance roller and the second conveyance roller to reversely rotate to reversely convey the rolled paper until the leading edge of the rolled paper reaches a position somewhat out side as compared with the contact of the discharge roller 14 with the spur 15, that is, the second conveyance, or the position B (cf. FIG. 11) (706).

In the state that the leading edge of the rolled paper returns to the position B in this manner, the rolled paper is still supported by the first conveyance roller and the second conveyance roller. For this reason, width of the rolled paper and positions of the side edges are detected by sensors (not illustrated) provided on the carriage 17 (707). The arrangement and function of the sensors are well known. Thus, details of the sensors will be omitted.

Next, the rolled paper is fed forward by about 300 mm again (708) to perform a skew feed check (709). This is to confirm the presence of the skew feed by the system in addition to the skew feed adjustment by the user. In order to implement this, again, positions of the side edges are detected and compared with the positions of the side edges detected in the step 707, so that the presence of the skew feed is decided. In the event that it is decide that the skew feed exists, the process returns to the step 703 to give the user an opportunity for the skew feed adjustment again.

In the step 709, in the event that it is decided that the skew feed is absent, a suppression flag for the cutting operation is investigated (710). If the flag offers an ON (a cut suppression), the process goes to a step 714 skipping steps 711–713. If the flag offers an OFF, the rolled paper is forward conveyed until the leading edge of the rolled paper goes over the cutting position 26 (711). Thereafter, the rolled paper is cut at the cutting position 26 (712). The reason why the leading edge of the rolled paper just now set (virgin paper) is cut is that the leading edge is not always associated with the proper cutting.

Next, the leading edge of the rolled paper is returned to the position of the sensor 24 (713). The reason why this is to do so is that it is detected that the rolled paper is surely cut on the basis of a variation of the output of the medium sensor 24. Next, in order to surely set the leading edge of the rolled paper to the position in which the leading edge margin is the minimum, prior to starting the image formation, the leading edge of the rolled paper is returned to the position C. However, at the position C, the leading edge of the rolled paper is separated from the second conveyance roller. Consequently, the extension operation for the extension guide is conducted before the leading edge of the rolled paper is returned to the position C (715). However, if the suppression flag offers the ON (extension suppression) through the investigation (714) of the suppression flag mentioned above, the process goes to a step 716 skipping the step 715.

In the step 716, the leading edge of the rolled paper is returned to the position C. In a step 717, the rolled paper is conveyed forward again so that the leading edge of the rolled paper is adjusted. Incidentally, the reason why the leading edge of the rolled paper is returned to the position C in order to set the leading edge of the rolled paper to the position in which the leading edge margin is the minimum is that the first conveyance roller is driven to remove the back-lash of the gear, and in this condition the leading edge of the rolled paper is supported by the second conveyance roller. Further, the adjustment for the leading edge position is implemented by, for example, such a control that after detection of the leading edge of the rolled paper by the medium sensor 24, the rolled paper is fed by further several mm.

At this stage, the set action for the recording medium for image formation is substantially completed, and as a result, the extension guide becomes unnecessary. Thus, the extension guide is put back in the case 31 (719). It is noted, however, that in the event that the extension action is suppressed (Yes in step 718), this step 719 is unnecessary, and thus it is bypassed.

In this manner, the initial set action for the rolled paper is completed.

Figure 9:
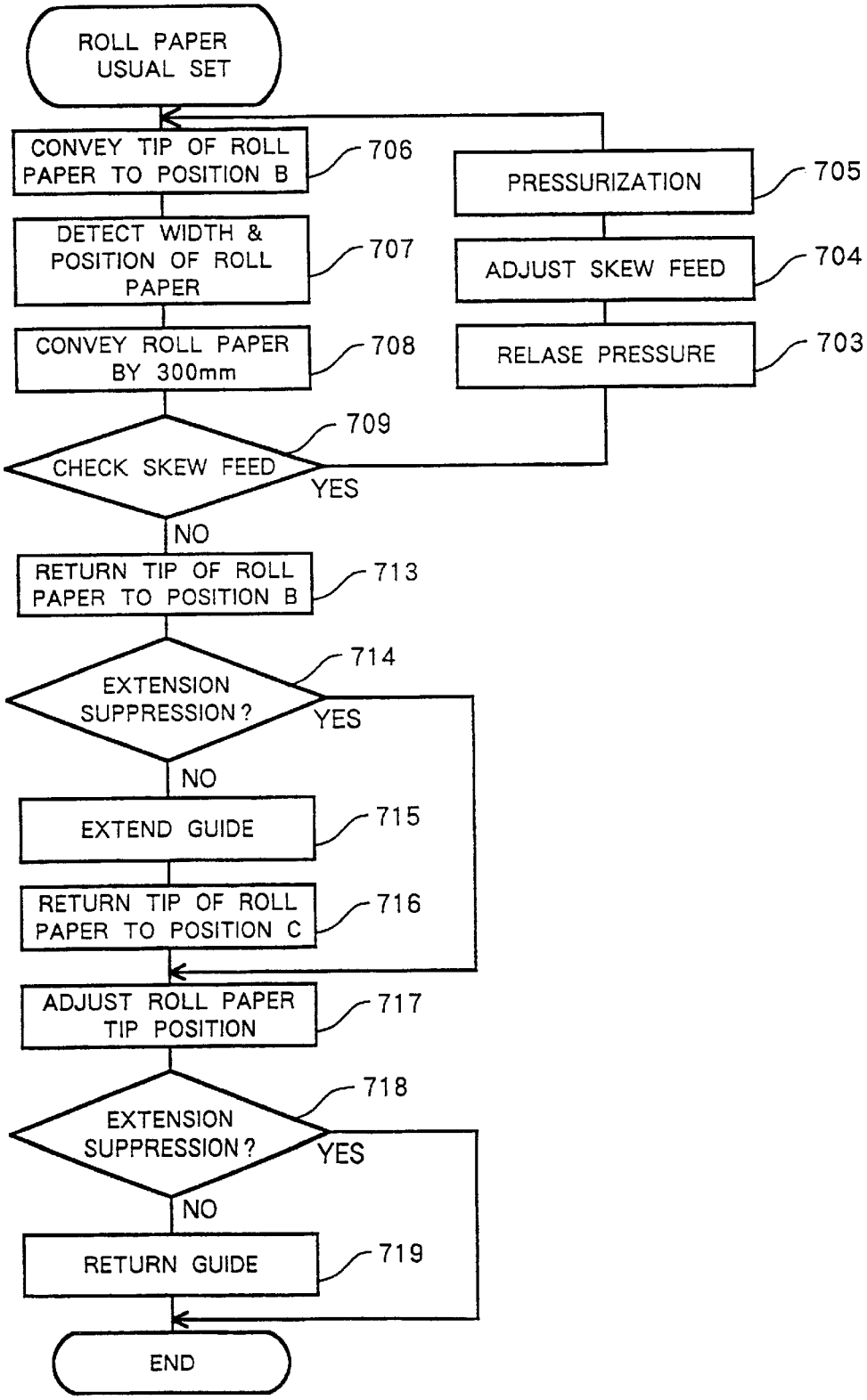
FIG. 9 is a flowchart for a processing of a rolled sheet usual setting operation of FIG. 7 by way of example.

Next, with reference to FIG. 9, there will be explained the process flow for the usual set action for the rolled paper, which has been explained in conjunction with the step 604 in FIG. 7.

This process is for performing a sheet setting for a new print process every completion of print process, on the rolled paper once initially set. With respect to the detailed process, as will be seen from FIG. 9, the initial skew feed adjustment by the user and the leading edge cutting become unnecessary, and it is completely the same as the process shown in FIG. 8, excepting for the steps 701–702 and the steps 710–712. Thus, the redundant explanation will be omitted.

Figure 10:
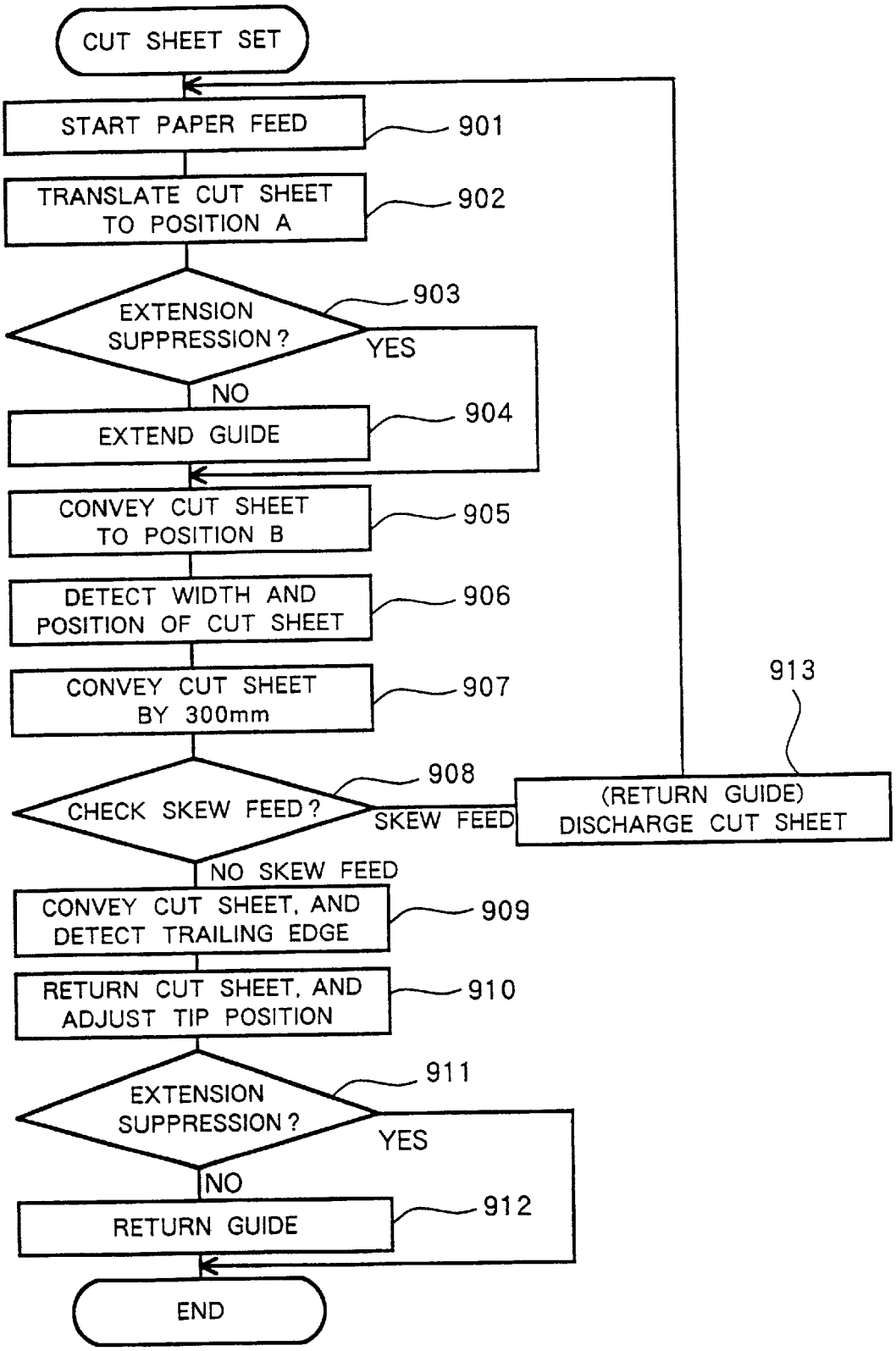
FIG. 10 is a flowchart for a processing of a cut sheet setting operation of FIG. 7 by way of example.

Next, with reference to FIG. 10, there will be explained the process flow for the set action for the cut sheet, which has been explained in conjunction with the step 605 in FIG. 7.

Figure 11:
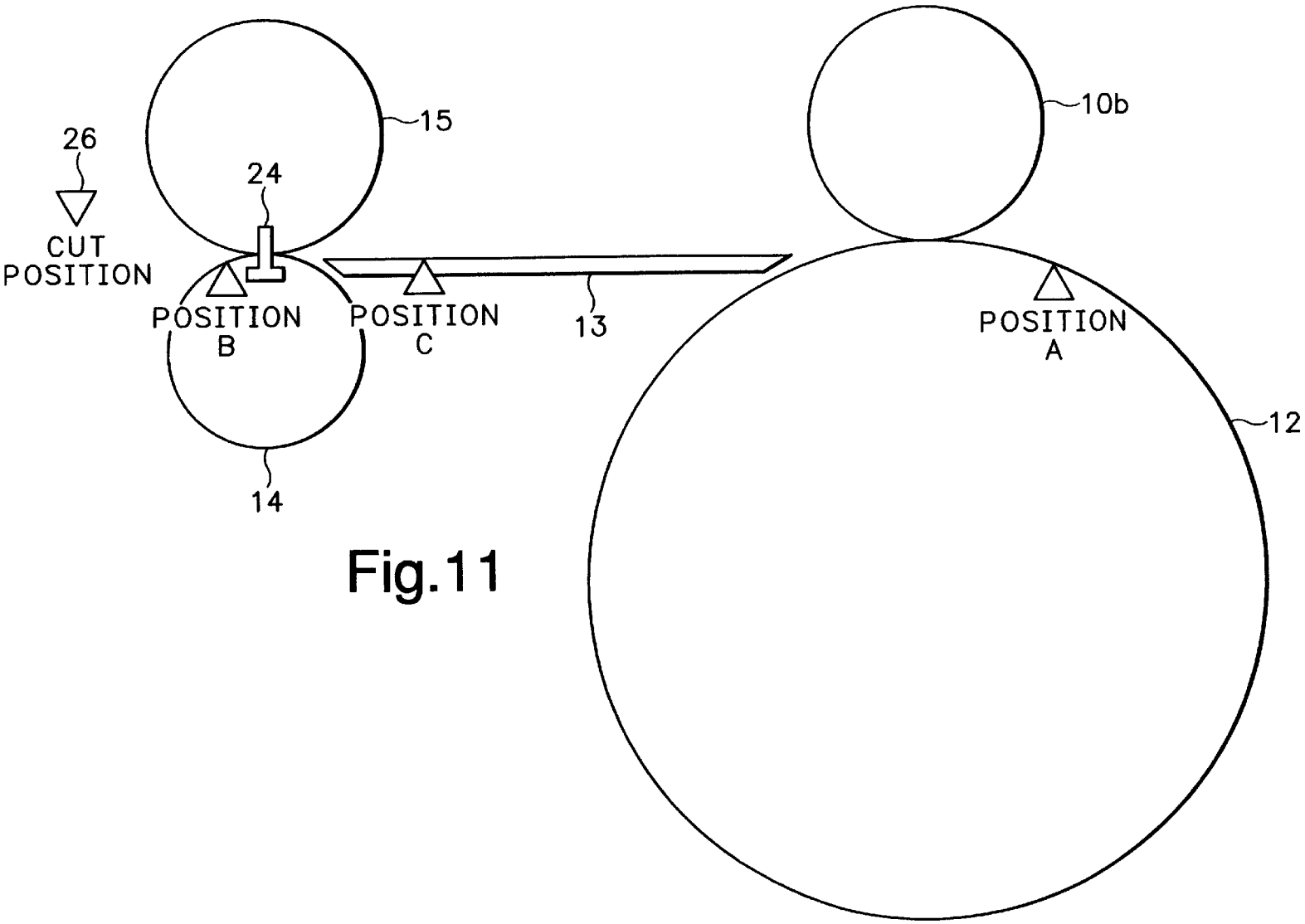
FIG. 11 is an explanatory view for various positions associated with the first conveyance roller and the second conveyance roller in the image forming apparatus of FIG. 1.

First, when the feed of the cut sheet is initiated (901), the cut sheet is conveyed until the leading edge of the cut sheet reaches the position A (cf. FIG. 11). In order to detect the fact that the leading edge of the cut sheet reaches the position A, while it is acceptable that a medium sensor is provided at the position A, it is also possible to detect the position A through a measurement of the conveyance distance of the cut sheet after detection of the leading edge of the cut sheet by a cut sheet medium sensor (not illustrated) for detecting the insertion of the cut sheet. At that time, the extension guide is extended (904). However, in the event that the extension suppression flag is set as mentioned above ("Yes" in step 903), the step 904 is bypassed. Next, the cut sheet is conveyed until the leading edge of the cut sheet reaches the position B (905). Here, in a similar fashion to that of the rolled paper, the width of the cut sheet and the position of the side edge are detected (906).

Thereafter, the cut sheet is discharged out side about 300 mm (907), and the system performs a skew feed check (908). This skew feed check can be performed in accordance with the same way as the step 709 in FIG. 8, which has been explained with reference to FIG. 8. In the event that the system decides that the skew feed is present, the cut sheet is discharged (913). At that time, in the event that the extension guide is extended, the extension guide is returned to the home position. Thereafter, the process goes to the step 901 to do over again from the sheet feed as to the new cut sheet.

In the event that the system decides that the skew feed is absent, the cut sheet is conveyed in the forward direction so that the medium sensor detects the trailing edge of the cut sheet (909). This medium sensor is the same as the cut sheet medium sensor (not illustrated) disposed at the sheet feed entrance as mentioned above. Thus, it is possible to identify the length of the conveyance direction of the cut sheet. Next, after the leading edge of the cut sheet is returned to the position C, the cut sheet is conveyed again to regulate the leading edge position (910). This regulation of the leading edge can be performed in accordance with the similar fashion to that of the rolled paper. Thereafter, the extension guide is returned to the home position (912), as far as the extension suppression is not set up, and thus the cut sheet set action is terminated.

Incidentally, according to the present embodiment, since there is assumed a plotter suitable for use of a large-sized cut sheet, the skew feed check, the trailing edge detection and the like are performed. It is noted, however, that a recording medium conveying apparatus of the present invention is applicable also to an image forming apparatus in which those actions are not performed.

Here, there will be described more in detail a difference between the rolled paper and the cut sheet in timing for use of the extension guide.

Figure 12:
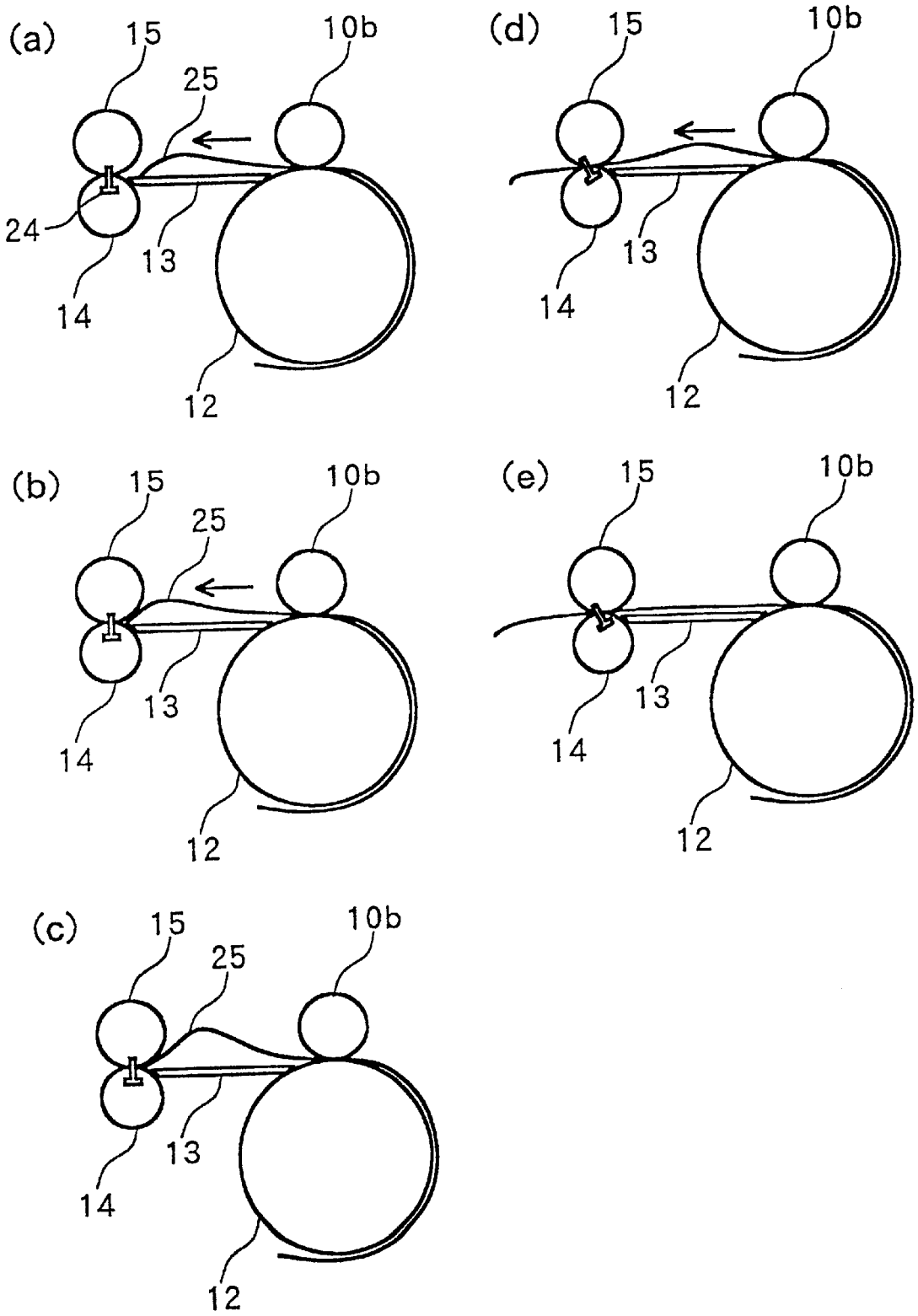
FIG. 12 is an explanatory view showing a rolled sheet conveyance process in case of no extension guide according to the present embodiment.

With reference to FIG. 12, there will be described a behavior of a rolled paper between the first and second conveyance rollers in the event that no extension guide is used.

As a phenomenon peculiar to rolled papers it is known that the rolled papers fall into the habit of curl. Hence, it is usual that the initial set for a rolled paper is performed in such a manner that the rolled paper downward curls in the upper of the print plate 13. In step 713 of FIG. 8, in the state that the leading portion of the rolled paper 25 is located at the position C (cf. FIG. 11), when the leading portion of the rolled paper 25 curls, as shown in FIG. 12(*a*), the tip of the rolled paper 25 is in contact with the upper face of the print plate 13 to take such a formation that the portion located at immediately after the tip of the rolled paper 25 slightly rises. In this state, when the rolled paper 25 is conveyed forward for the leading edge position regulation, as shown in FIG. 12(*b*), the tip of the rolled paper 25 reaches the second conveyance roller, that is, a slot between the discharge roller 14 and the spur 15, and it happens that the rolled paper 25 rather rises on the print plate 13 before the tip of the rolled paper 25 is taken into the second conveyance roller.

Further, when the rolled paper 25 is conveyed ahead, as shown in FIG. 12(*c*), the tip of the rolled paper 25 is taken into the second conveyance roller, and the medium sensor 24 turns on. Thus, the recording medium set action is substantially completed. However, maintaining the state that the rolled paper 25 rises on the print plate 13 involves such a possibility that the print head 19 (cf. FIG. 2) interferes with the rolled paper 25. Otherwise, the distance between the print head 19 and the rolled paper 25 is too short and as a result the ejection position of ink is uneven. This involves a deterioration in quality of printing images. Hitherto, in order to cope with this problem, the conveying speed of the second conveyance roller is set up to be faster than that of the first conveyance roller to absorb the rising portion of the rolled paper 25, and thereby providing a flatness of the rolled paper 25 on the print plate 13 (FIG. 12 (*d*) and (*e*)). However, this means that the tip of the rolled paper 25 advances by the corresponding rising quantity, and thus the head margin of the print image becomes too large. This involves such a problem that the rolled paper 25 is wasted.

Figure 13:
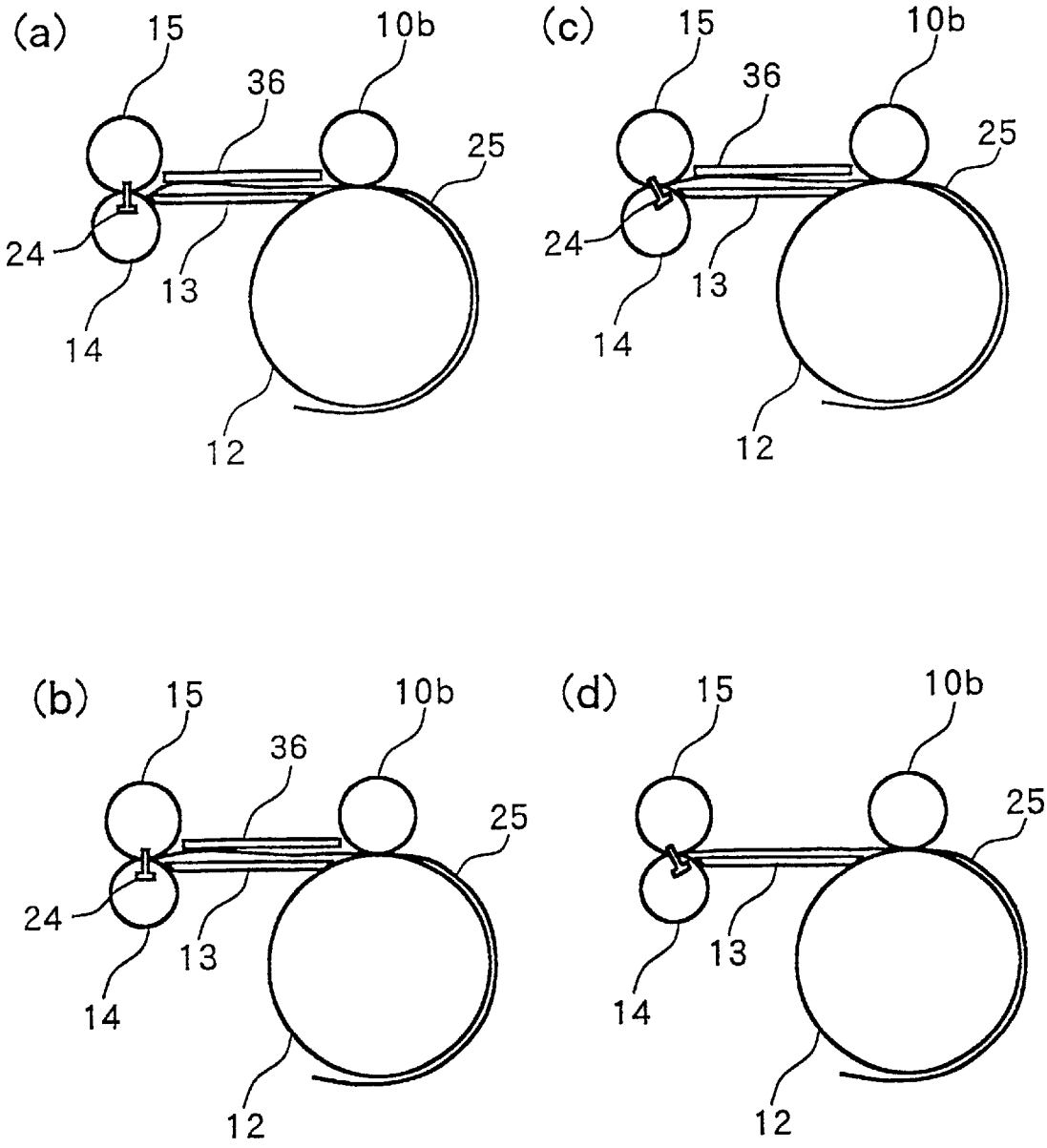
FIG. 13 is an explanatory view showing a rolled sheet conveyance process in case of the presence of the extension guide according to the present embodiment.

According to the present embodiment, the extension guide 36 is extended before the rolled paper 25 is returned to the position C, so that the rolled paper 25 is covered by the extension guide 36. Thereafter, the rolled paper 25 is returned to the position C (FIG. 13(*a*)), and the rolled paper 25 is conveyed ahead again, whereby the occurrence of the rising of the rolled paper 25 is prevented when the tip of the rolled paper 25 is taken into the second conveyance roller (FIG. 13 (*b*) and (*c*)).

Incidentally, the reason why the rolled paper 25 is cut out, and the extension guide 36 is extended after the tip of the rolled paper 25 is returned to the position of the medium sensor 24, in the above-mentioned conveyance process is that as mentioned above, returning the tip of the rolled paper 25 the position of the medium sensor 24 makes it possible through the medium sensor 24 to confirm that the rolled paper 25 is properly cut out, and it is more preferable from the viewpoint of measures to deal with the conveyance obstruction that after the confirmation the extension guide 36 is extended. Further the reason why the tip of the rolled paper 25 is detected by the medium sensor 24, and thereafter immediately stopping the conveyance, and the rolled paper 25 is returned to the position C without immediately starting the printing, and then the rolled paper 25 is fed to the medium sensor 24, is that as mentioned above, the influence of the back-lash of the gears of the conveyance drive system is suppressed, and starting the print immediately after the conversion involves unevenness in head margin. After the tip of the rolled paper 25 is taken into the second conveyance roller so that the medium sensor 24 turns on, the extension guide 36 is removed from the rolled paper 25 for the purpose of the image formation (FIG. 13(*d*)). In this manner, an effect of the extension guide 36 makes it possible to avoid the necessity for the additional tip feed needed for solving the problem of rising of the rolled paper 25. As a result, it is possible to avoid such a situation that the head margin of the rolled paper 25 becomes unnecessarily large.

Incidentally, after the extension guide 36 is extended, lifting by the engagement auxiliary mechanism 50 is released. Therefore, the extension guide 36 slightly goes down, so that the lower face of the extension guide 36 comes close to the rolled paper 25.

There are three reasons why the extension guide 36 is not used at steps before the first cutting of the rolled paper tip (FIG. 8, step 712) in the initial set action for the rolled paper 25. The first reason is that in case of the rolled paper 25, the skew feed regulation action is performed by the user, and thus the use of the extension guide 36 would make it hard to see the rolled paper 25 on the print plate 13 and also make it hard to perform the regulation. The second reason is that in the initial set, a possibility of an occurrence of a jam is relatively high owing to the user's operating error and the like, and particularly in the event that a jam occurs at the place wherein the tip of the rolled paper enters the second, the use of the extension guide 36 would make it hard to perform a work for jam release. The third reason is that the rolled paper 25 curls downward on the print plate and thus there is always no need to prepare the extension guide 36 in order that the tip of the rolled paper 25 is taken into the second conveyance roller.

Figure 14:
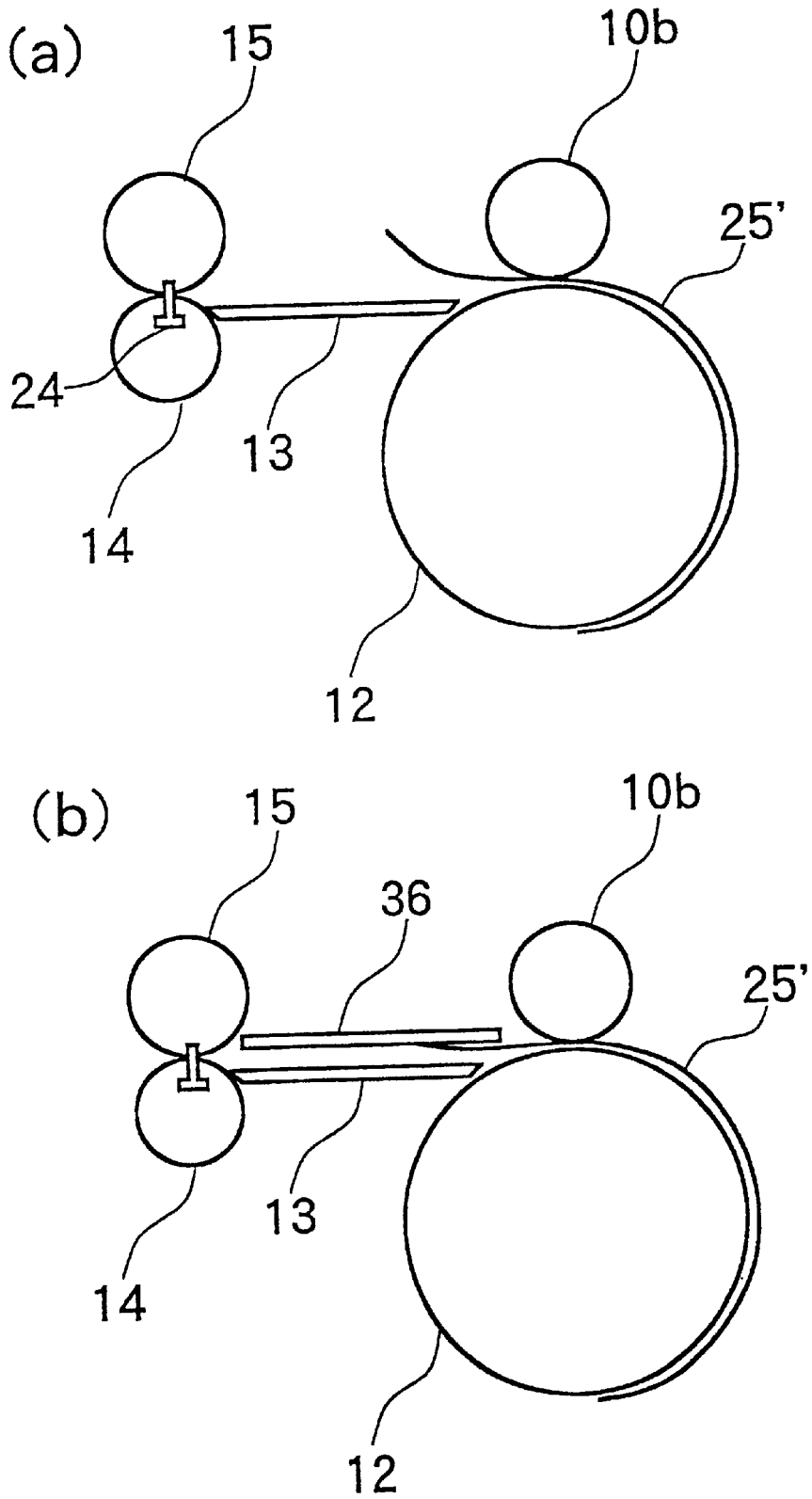
FIG. 14 is an explanatory view showing cut sheet conveyance processes in case (a) of no extension guide according to the present embodiment and in case (b) of the presence of the extension guide according to the present embodiment.

On the contrary, in case of a cut sheet, it is different from a rolled paper which is constant in a curl direction, it happens that the tip of the cut sheet 25', which is reversed in the travelling direction by the drive roller, curls upward, as shown in FIG. 14 (*a*), depending on the quality of sheets, the thickness of sheets and the saving state of sheets. Consequently, if any guide does not exist, there is a possibility that the tip of the cut sheet 25' cannot enter the second conveyance roller. Particularly, such a situation often occurs for the image forming apparatus in which a distance between the first conveyance roller and the second conveyance roller is short. In view of the foregoing, according to the present embodiment, at the latest before the tip of the cut sheet 25' is discharged from the first conveyance roller, the extension guide 36 is extended to form a temporal recording medium guide. In this manner, it is possible to feed the tip of the cut sheet 25' to the second conveyance roller even if it is the cut sheet 25' involved in the upper curl.

It is possible to perform the above-mentioned extension suppression of the extension guide 36 by a control button 511*b* or an instruction of the user through an on-line. The instruction information is stored in a memory 515 in the form of a flag (not illustrated). If the flag is on, for example, then the extension action of the extension guide 36 is suppressed.

Usually, the more thickness of sheets, it is harder to remove peculiarities of curls, since such a sheet is firm in its property. Generally, it is hard that a film sheet is subjected to peculiarities of curls. Oppositely, it is easy that a coat sheet, which has undergone coating on the surface thereof, is subjected to peculiarities of curls. Thus, users can optionally select on the basis of the above-mentioned matters between a mode in which a suppression of the extension guide is applied to the thin sheet and the film sheet and a mode in which a suppression of the extension guide is not applied to the thick sheet and the coat sheet. It is acceptable to provide a thick sheet/thin sheet designation button and the like instead of the extension suppression button 511*b* shown in FIG. 6 in order that users are not puzzled.

Also it is possible to suppress the extension action in view of various primary factors. With respect to rolled papers, usually, when there are plenty of residual quantity, the curl is relatively small since the curvature radius of the paper in its entirety is large. For this reason, at the first of the initial set of the rolled paper, the suppression flag is initially set to an ON to suppress the extension action. On the other hand, the rolled paper residual quantity detecting unit 524 (FIG. 6) is used to automatically detect the residual quantity of the rolled sheet, and when the residual quantity of the rolled sheet becomes less than a certain value, the suppression flag is set to an OFF. In this manner, when the quantity of the residual quantity of the rolled sheet is decreased, so that the curl of the rolled sheet becomes large, the extension guide 36 can be automatically used effectively.

Next, with reference to FIG. 15, there will be explained by way of example a structure of the rolled paper residual quantity detecting unit 524 for detecting that the residual quantity of the rolled sheet becomes less than a predetermined amount.

Figure 15:
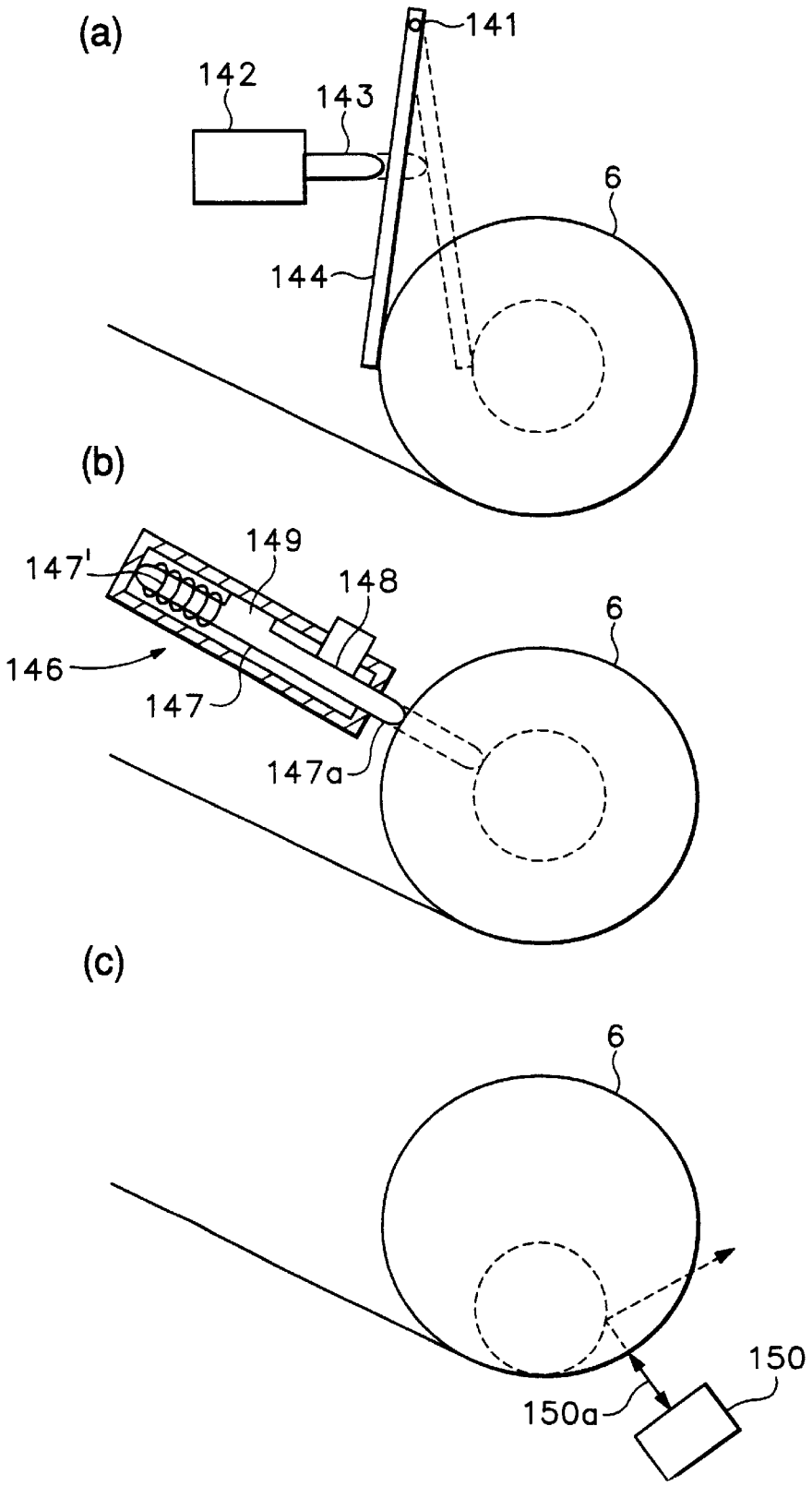
FIG. 15 is an explanatory view for means for detecting a residual quantity of rolled sheet according to the present embodiment.

The rolled paper residual quantity detecting unit (524 in FIG. 6) comprises, in FIG. 15(*a*), a movable member 144 an end 141 of which is rotatably supported within the apparatus, and a switch 142 fixed within the apparatus. The switch 142 has a slide member 143 which is enabled by a spring (not illustrated) so that the slide member 143 is in contact with a side of the movable member 144.

While the residual quantity of the rolled sheet 6 is plenty, the free end of the movable member 144 is pressed by the periphery of the rolled paper, so that the slide member 143 is urged into the switch 142. As the residual quantity of the rolled sheet is decreased, the free end of the movable member 144 follows the variation of the periphery of the rolled paper, so that the slide member 143 gradually projects in accordance with the spring force. When the slide member 143 projects to a certain position, an internal electric contact (not illustrated), which has been closed by an urge of the slide member 143, is released. This signal makes it possible to automatically detect the decrease of the residual quantity of the rolled sheet. At the time point of this detection, the extension suppression flag is released.

According to the structure as shown in FIG. 15 (*a*), since the rotating action of the movable member 144 is utilized, it is possible to reduce the magnitude of the positional variation of the periphery of the rolled paper and transfer the reduced one to the slide member 143 of the switch 142. It is possible to arrange the switch 142 in such a manner that the positional change of the slide member 143 is optically detected.

FIG. 15 (*b*) shows a rolled paper residual quantity detection unit 146 which is fixed within the apparatus. The rolled paper residual quantity detection unit 146 has inside a slide member 147. The slide member 147 is enabled toward the outside by a spring 147' so that a tip 147*a* is in contact with the periphery of the rolled paper 6. A photo-interrupter 148 is disposed at the side portion of the rolled paper residual quantity detection unit 146. While the residual quantity of the rolled paper 6 is plenty, such a state that an optical path of the photo-interrupter 148 is not interrupted is kept. However, at the time point when the residual quantity of the rolled paper 6 is less than a certain amount, the optical path of the photo-interrupter 148 is interrupted by a shielding unit 149 provided on the slide member 147. This arrangement also makes it possible to detect the change of the residual quantity of the rolled paper. An arrangement such that a shielding of the shielding unit 149 is released in accordance with zero of the rolled paper 6 or the residual quantity of the rolled paper 6 involved in immediately before zero of the rolled paper 6 makes it possible to detect the termination of the rolled paper 6.

The arrangements shown in FIGS. 15 (*a*) and 15 (*b*) correspond to an apparatus in which even if the residual quantity of the rolled paper 6 is varied, the center shaft position of the rolled paper 6 is constant and not changed, while the arrangement shown in FIG. 15 (*c*) corresponds to an apparatus in which the center of the rolled paper 6 moves in accordance with the use of the rolled paper 6.

According to an example of arrangements of the rolled paper residual quantity detecting unit 524, there is provided a photo detector 150 for emitting a ray of light and detecting the reflected light to generate a signal. The photo detector 150 is located off the lower right of the rolled paper 6 and is disposed in such a manner that while the residual quantity of the rolled paper 6 is plenty, the emitted ray of light 150*a* is incident substantially perpendicularly with respect to a sheet surface of the rolled paper 6. Therefore, while the residual quantity of the rolled paper 6 is plenty, the reflected light of the emitted ray of light returns to the photo detector 150. However, as the residual quantity of the rolled paper 6 is decreased, the center of the rolled paper 6 shifts, so that the emitted ray of light 150*a* is incident obliquely with respect to the periphery of the rolled paper 6, and whereby the reflected light is gradually decreased. Thus, at the time point when the residual quantity of the rolled paper 6 is decreased to a certain amount, the photo detector 150 cannot detect the reflected light, and generates a signal involved in the rolled paper residual quantity decrease. At this time point, the extension suppression flag is released.

In this manner, an arrangement such that the extension guide 36 is used from the time point when the residual quantity of the rolled paper 6 becomes less than a predetermined amount makes it possible to avoid such a situation that the extension guide 36 is unnecessarily used. Thus, it is possible to reduce a time for printing process during a period in which the extension guide 36 is suppressed.

Figure 16:
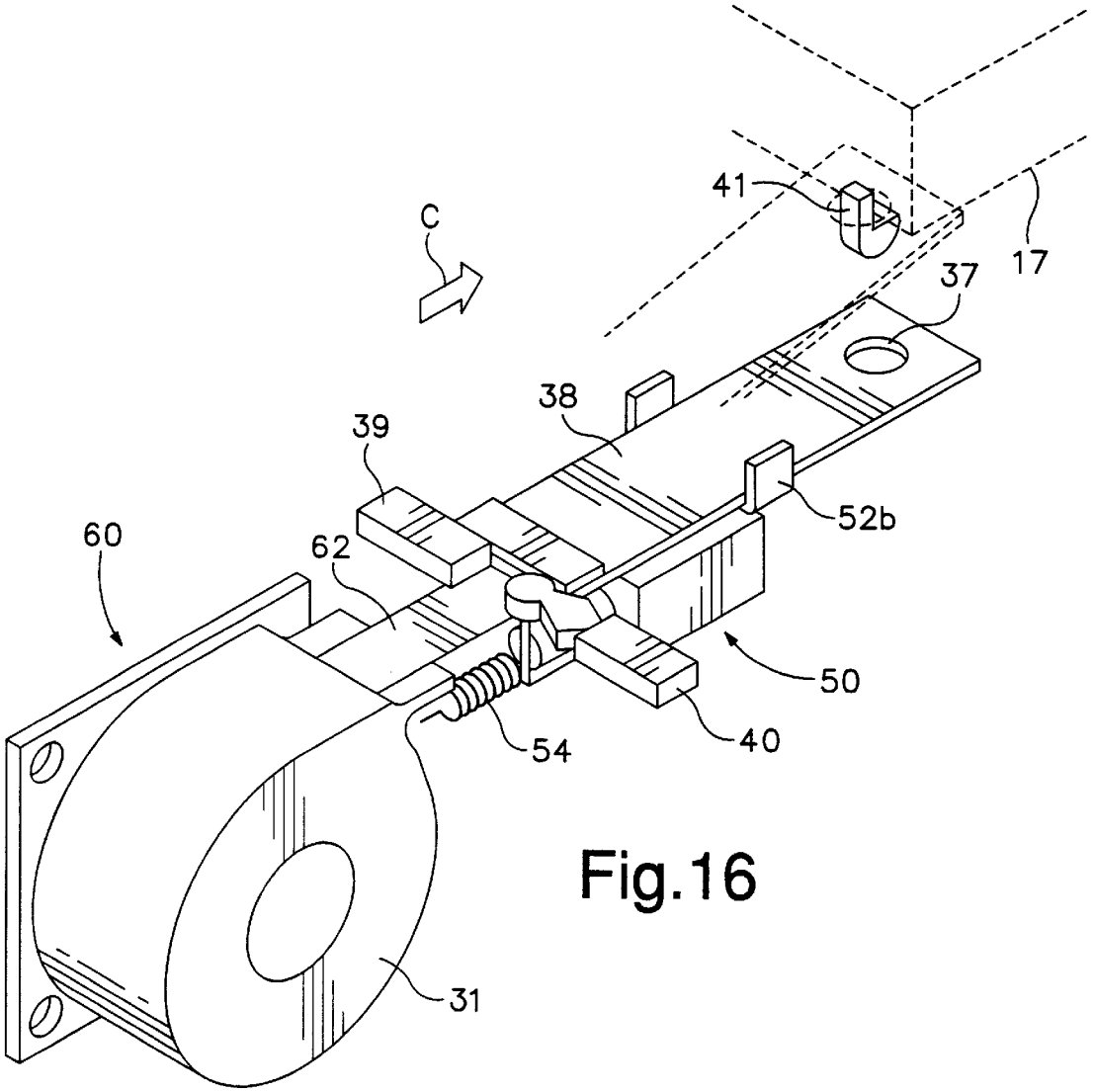
FIG. 16 is a schematic construction view of an alternative embodiment of the extension guide unit.
Figure 17:
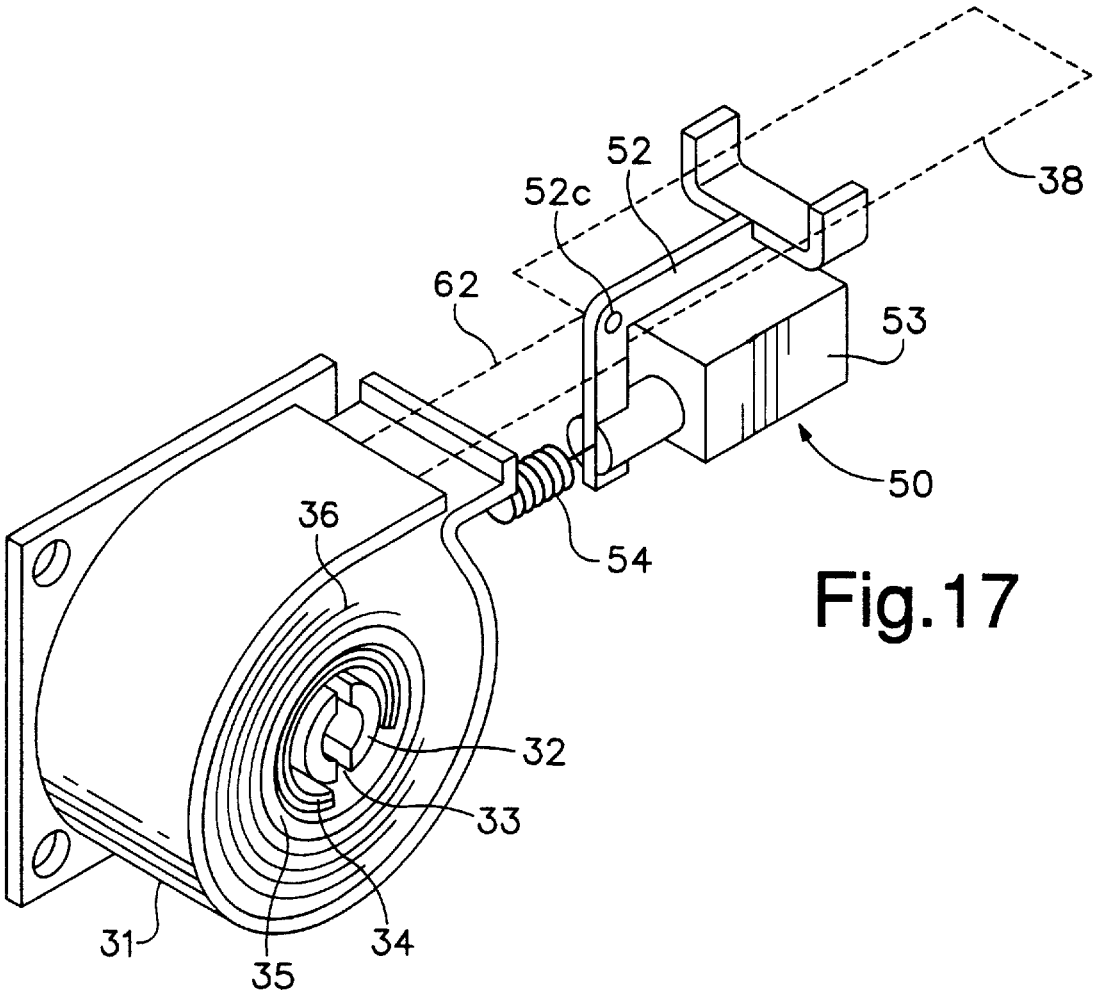
FIG. 17 is a schematic construction view of an internal structure of the extension guide unit shown in FIG. 16.
Figure 18:
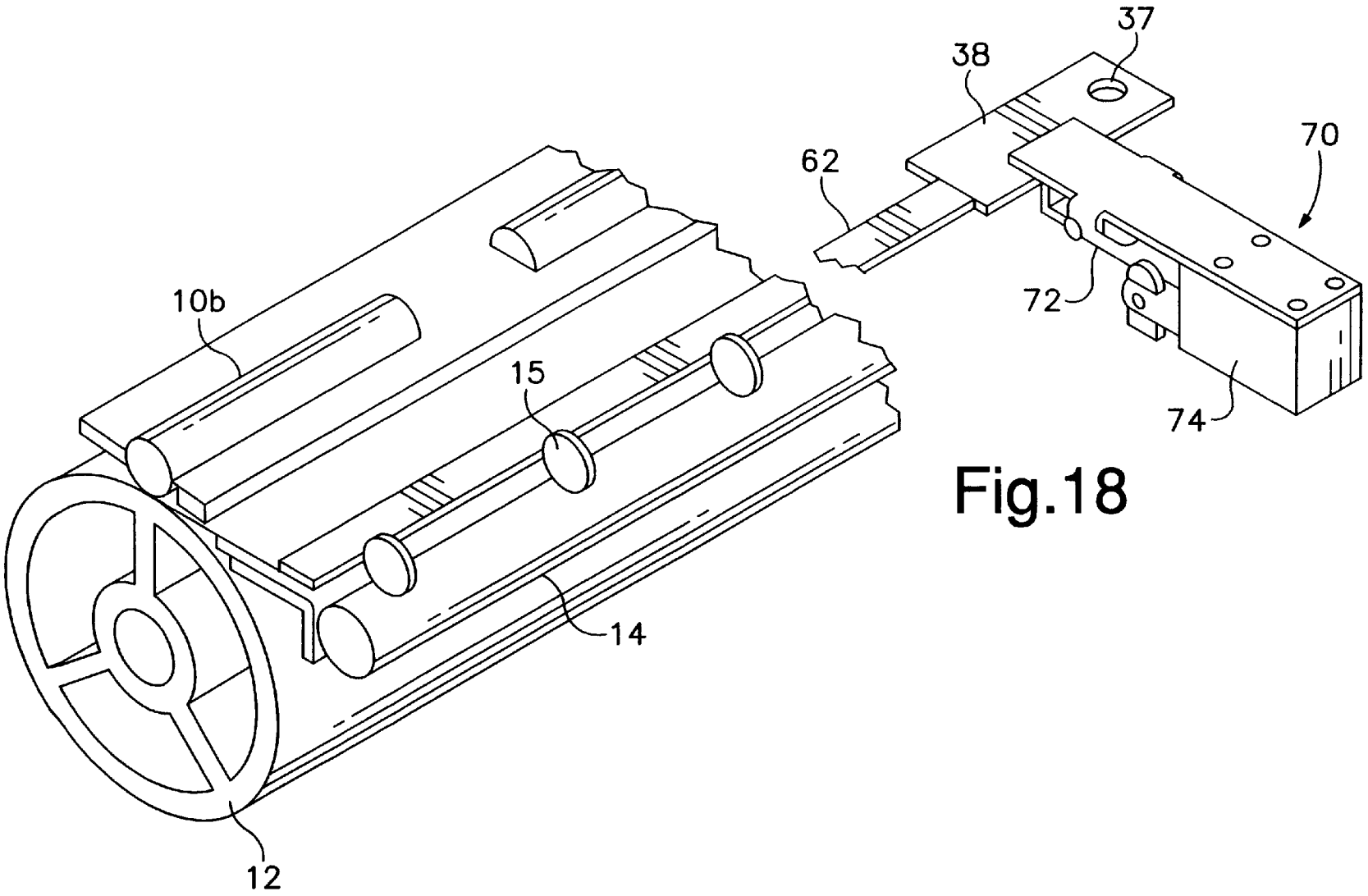
FIG. 18 is an explanatory view for the extension sheet clamp and the supporter shown in FIG. 16.

Next, with reference to FIGS. 16, 17 and 18, there will be described another example of the extension guide. In these figures, the same parts are denoted by the same reference numbers as those of FIGS. 3 and 4.

An important feature of an extension guide unit 60 resides in the point that a narrow band-like shaped extension sheet clamp 62 is used instead of the extension guide 36, and a supporter 70 is used.

The extension sheet clamp 62 is extended, in a similar fashion to that of the extension guide 36 shown in FIG. 3, in such a manner that the hook aperture 37 of the belt plate 38 is engaged with the hook 41 of the carriage 17. The supporter 70 (an example of the holding unit referred to in the present invention) is disposed in the vicinity of the belt plate 38 when the extension sheet clamp 62 is extended maximum. The supporter 70 supports the belt plate 38 by a solenoid 74 through a spring 72, as shown in FIG. 18. Thus, while the hook 41 of the carriage 17 is released from the belt plate 38, the extension sheet clamp 62 is kept to be extended. As will be described later, the width of the extension sheet clamp 62 is given with the range of 5 mm–10 mm, and thus it is possible to perform a printing on a recording medium by the print head 19 (cf. FIG. 2) mounted on the carriage 17 in the state that the extension sheet clamp 62 clamps a portion corresponding to a margin width of the conveyed recording medium.

After performing a band of print on a recording medium, the extension sheet clamp 62 is released from the supporter 70. The extension sheet clamp 62 free-runs by the spring force of the plate spring 34, and is stored in the extension guide holder 31 in a similar fashion to that of the the extension guide 36. Incidentally, it is acceptable that the extension sheet clamp 62 is moved in accordance with a movement of the carriage 17, but not free-running, in such a manner that the hook aperture 37 of the belt plate 38 is again engaged with the hook 41 of the carriage 17.

After performing a band of print on a recording medium, the recording medium is conveyed by the corresponding one band, and the similar operation as mentioned above is repeated so that a printing is performed on a recording medium in the state that the extension sheet clamp 62 clamps a portion corresponding to a margin width of the recording medium. Printing in this manner makes it possible to improve quality of an image. It is noted that according to the present embodiment, the width of the extension guide 36 shown in FIG. 3 is set up within the range of 30 mm–40 mm, and the width of the extension sheet clamp 62 is set up within the range of 5 mm–10 mm.

Next, with reference to FIGS. 19 and 20, there will be explained an alternative embodiment of the extension guide unit. In those figures, the same parts are denoted by the same reference numbers as those of FIGS. 3 and 4.

An aspect of the extension guide unit resides in the point that the conveyance ability for recording medium is improved by means of inclining an extension guide. An extension guide unit 80 is provided with a cylinder-shaped extension guide holder 31 adapted for holding the extension guide 36 in a wound state on a freedom basis in going in and out, in a similar fashion to that of the above-mentioned extension guide unit 30. The center shaft 32 is fixed on the center of the extension guide holder 31. One end of the plate spring 34 is fixed on the slot 33 formed on the center shaft 32. Another end of the plate spring 34, which is wound clockwise facing a paper surface of FIG. 20, is fixed on the drum 35 which is fixed rotatably in the extension guide holder 31.

One end of a strip-like configuration of extension guide 36 in the state wounded clockwise similar to the plate spring 34 is fixed on the drum 35, and another end of the extension guide 36 is derived from an inlet and outlet 31*a* of the extension guide holder 31, and is fixed on a belt plate 90. A hook 92 is provided on the tip of the belt plate 90. When the belt plate 90 is drawn in an arrow C direction, the extension guide 36 fixed on the belt plate 90 against the enabling force of the plate spring 34 is drawn out from the extension guide holder 31. In this case, the enabling force of the plate spring 34 causes tension to occur on the extension guide 36, and thereby ensuring linearity and flatness of the extension guide 36.

In the event that the extension guide 36 is held into the extension guide holder 31 from the state that the extension guide 36 is drawn out from the extension guide holder 31, the extension guide 36 is translated as the carriage 17 moves. When the extension guide 36 is held in the extension guide holder 31, the belt plate 90 is stopped by the stopper 39 at a position (the home position) near the inlet and outlet 31*a* of the extension guide holder 31. At the same time as this stop, it is possible by a sensor such as microswitch, etc. to confirm the fact that the extension guide 36 is held in the extension guide holder 31.

Next, there will be described a function of the extension guide 36 using the belt plate 90 as a conveyance guide of a recording medium.

When the extension guide 36 is located at the home position, if the carriage 17 is translated to the home position, then hook 92 of the belt plate 90 is hooked on a hook aperture 96 formed below the carriage 17. In this manner, the extension guide 36 is drawn out from the extension guide holder 31 and is extended as the carriage 17 is translated.

Figure 21:
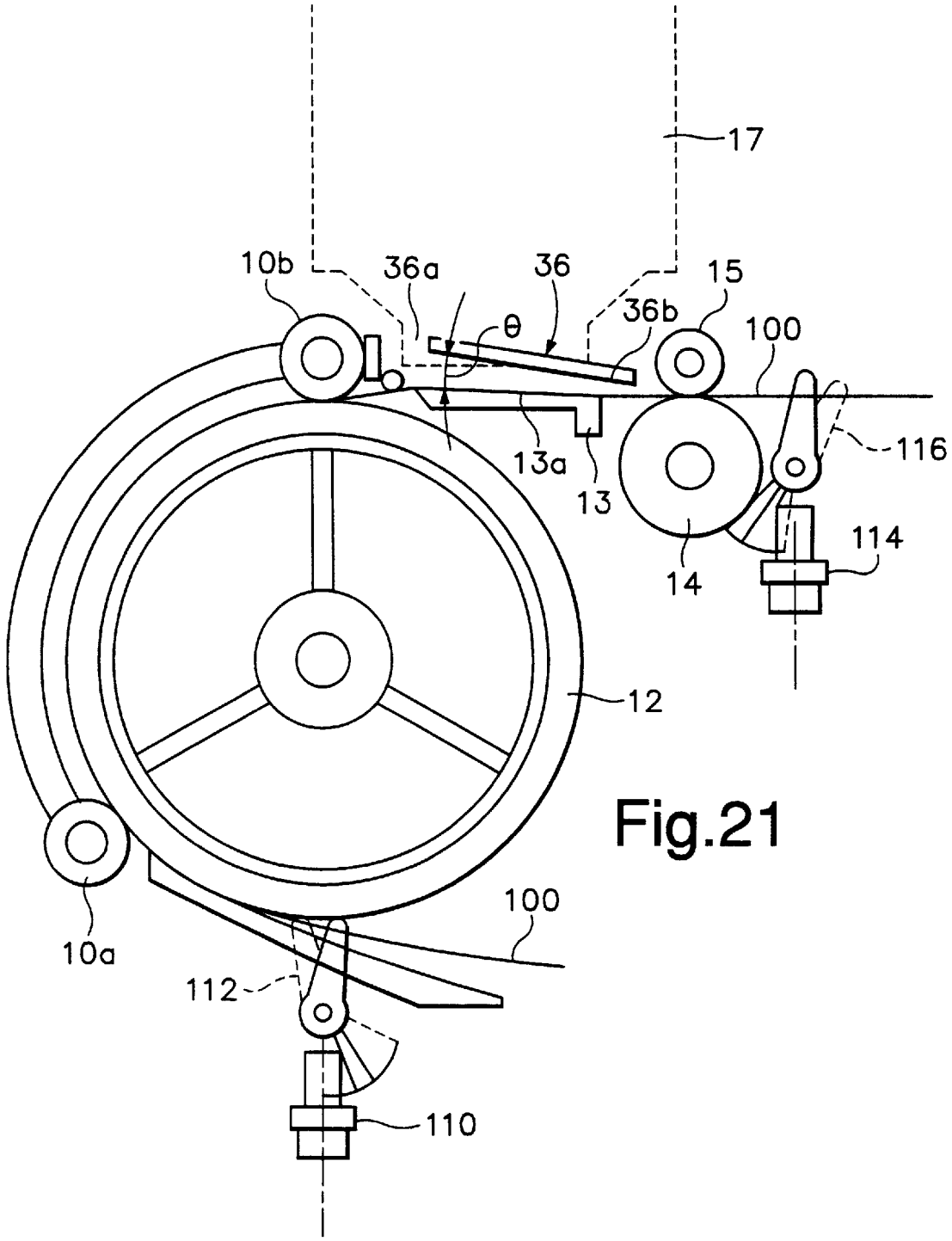
FIG. 21 is a typical illustration of the recording medium conveying apparatus looking from a direction perpendicularly intersecting the direction of the recording medium conveyance.

With reference to FIG. 21, there will be described a state that the extension guide 36 is drawn out.

When the extension guide 36 is drawn out from the extension guide holder 31 and is extended as the carriage 17 is translated, the extension guide 36 is extended in the space between a pair of the drive roller 12 and the sheet conveyance roller 10*b* and a pair of the discharge roller 14 and the spur 15. In other words, the extension guide 36 is extended across the portion located at the one side 13*a* of the print plate 13 of a recording medium 100 from the print plate 13 in a direction (an example of the intersection direction) perpendicularly intersecting the conveyance direction of the recording medium 100. At that time, as will be described later, the extension guide 36 is inclined by a predetermined angle in such a manner that an interval between the print plate 13 and the upward stream side portion 36*a* with respect to the conveyance direction of the extension guide 36 is wider than an interval between the print plate 13 and the downward stream side portion 36*b* with respect to the conveyance direction. Thus, the tip of the recording medium 100, which is supported by the drive roller 12 and the sheet conveyance roller 10*b* and is conveyed, is smoothly guided to the extension guide 36, so that the recording medium 100 reaches the discharge roller 14 and the spur 15 passing through a gap between the print plate 13 and the extension guide 36, and then the recording medium 100 is supported by the discharge roller 14 and the spur 15.

As mentioned above, the recording medium 100 is guided by the extension guide 36 and is conveyed maintaining the flatness between a pair of the drive roller 12 and the sheet conveyance roller 10*b* and a pair of the discharge roller 14 and the spur 15. This involves no problem such as a conveyance failure due to the curl of the tip of the recording medium 100.

Supporting the recording medium 100 by a pair of the drive roller 12 and the sheet conveyance roller 10*b* and also a pair of the discharge roller 14 and the spur 15 permits the carriage 17 to move in a holding direction of the extension guide 36 and return to the home position, while the hook 92 is hooked on the hook aperture 96 (cf. FIG. 19) of the carriage 17. When the belt plate 90 is in contact with the stopper 39 (cf. FIG. 19) and then stopped, and the carriage 17 is translated, the hook 92 comes off from the hook aperture 96 and the belt plate 90 goes down by its own weight. Thereafter, a printing (image formation) is performed on the recording medium supported by a pair of the drive roller 12 and the sheet conveyance roller 10*b* and a pair of the discharge roller 14 and the spur 15 as well.

Again with reference to FIGS. 19 and 20, there will be described a way of hooking the hook 92 on the hook aperture 96.

While an image is formed on a recording medium, the carriage 17 reciprocates. In this reciprocation, it is not preferable that the carriage 17 is in contact with the extension guide 36 and the associated parts (the belt plate 90 and the like). For this reason, there is so arranged that the interval between the hook 92 and the hook aperture 96 of the carriage 17 is kept constant so as not to be in contact with one another, even if the carriage 17 comes nearest the extension guide unit 80. However, even if the interval between the hook 92 and the hook aperture 96 is kept constant, in some extension guide 36, there is a need to hook the hook 92 on the hook aperture 96 to guide the recording medium. Here, a belt plate elevating mechanism 50 is used.

The belt plate elevating mechanism 50 is disposed below the belt plate 90 located at the home position. An "L"-like shaped belt plate elevating lever 94 is rotatably supported on the main frame of the plotter 1 (cf. FIG. 1). An under portion 94*a* of the belt plate elevating lever 94 is coupled with the solenoid 53. The solenoid 53 is enabled by the spring 54 in an arrow D direction. On the other hand, on the upper portion of the belt plate elevating lever 94, there is provided a belt plate receiver 94*b* for receiving the belt plate 90. When a predetermined signal is inputted to the solenoid 53, the solenoid 53 is operated in a direction opposite to the arrow D direction. In response to the operation of the solenoid 53, the belt plate elevating lever 94 pivots counterclockwise on a center shaft 94*c*, so that the belt plate receiver 94*b* of the belt plate elevating lever 94 is translated upward to raise the belt plate 90. In this state, when the carriage 17 moves toward the belt plate 90, the hook 92 can be hooked on the hook aperture 96. When the carriage 17 moves in the arrow C direction in the state that the hook 92 is hooked on the hook aperture 96, the extension guide 36 is drawn out from the extension guide holder 31 and is expanded.

As described above with reference to FIG. 21, the extension guide 36 is inclined by a predetermined angle $\ominus$ in such a manner that an interval between the print plate 13 and the upward stream side portion 36*a* with respect to the conveyance direction of the extension guide 36 is wider than an interval between the print plate 13 and the downward stream side portion 36*b* with respect to the conveyance direction. Thus, the tip of the recording medium 100, which is supported by the drive roller 12 and the sheet conveyance roller 10*b* and is conveyed, is smoothly guided to the extension guide 36, so that the recording medium 100 reaches the discharge roller 14 and the spur 15 passing through a gap between the print plate 13 and the extension guide 36, and then the recording medium 100 is supported by the discharge roller 14 and the spur 15. It is preferable that the predetermined angle $\ominus$ is between 5° and 20°

Figure 19:
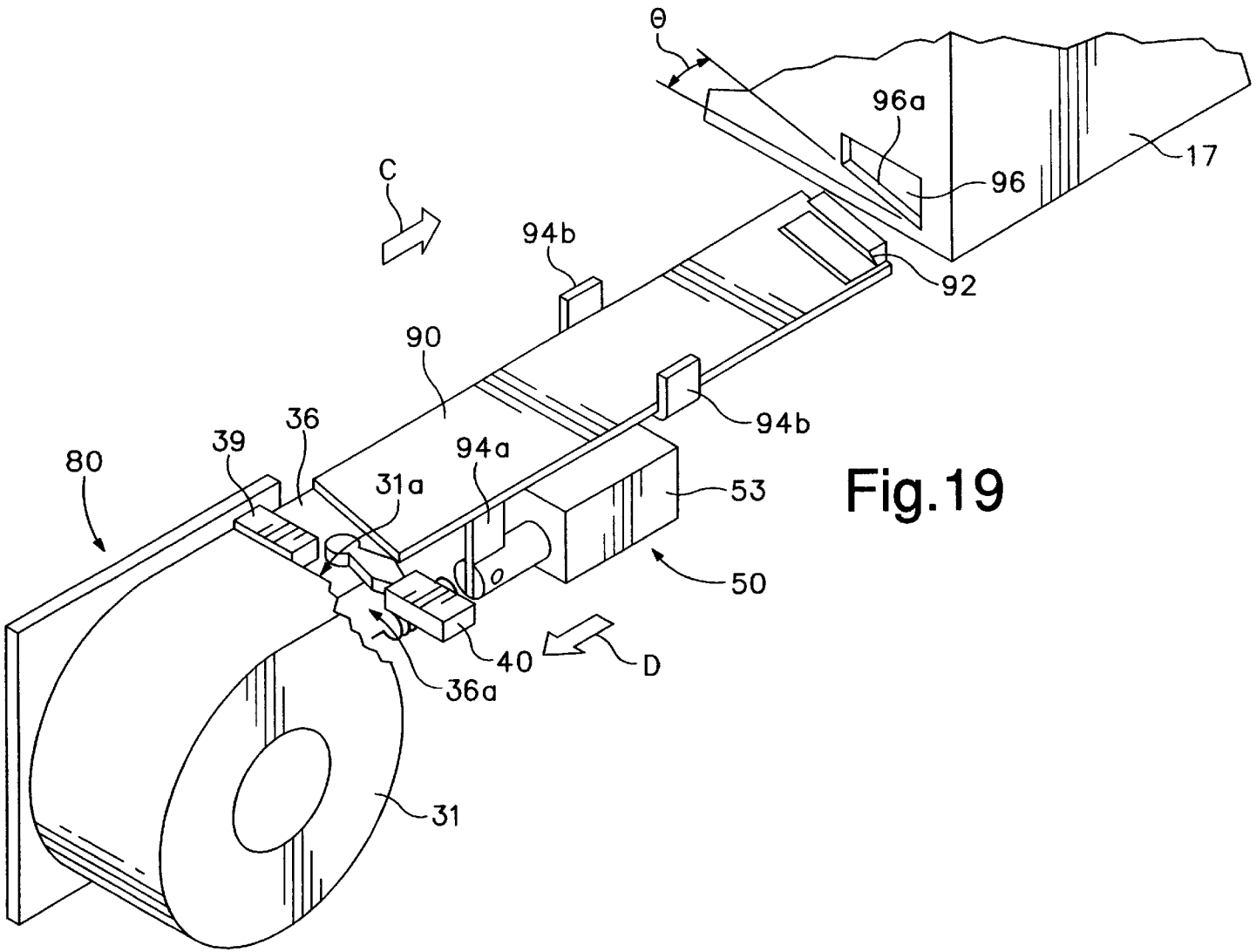
FIG. 19 is a schematic construction view of a further alternative embodiment of the extension guide unit.
Figure 20:
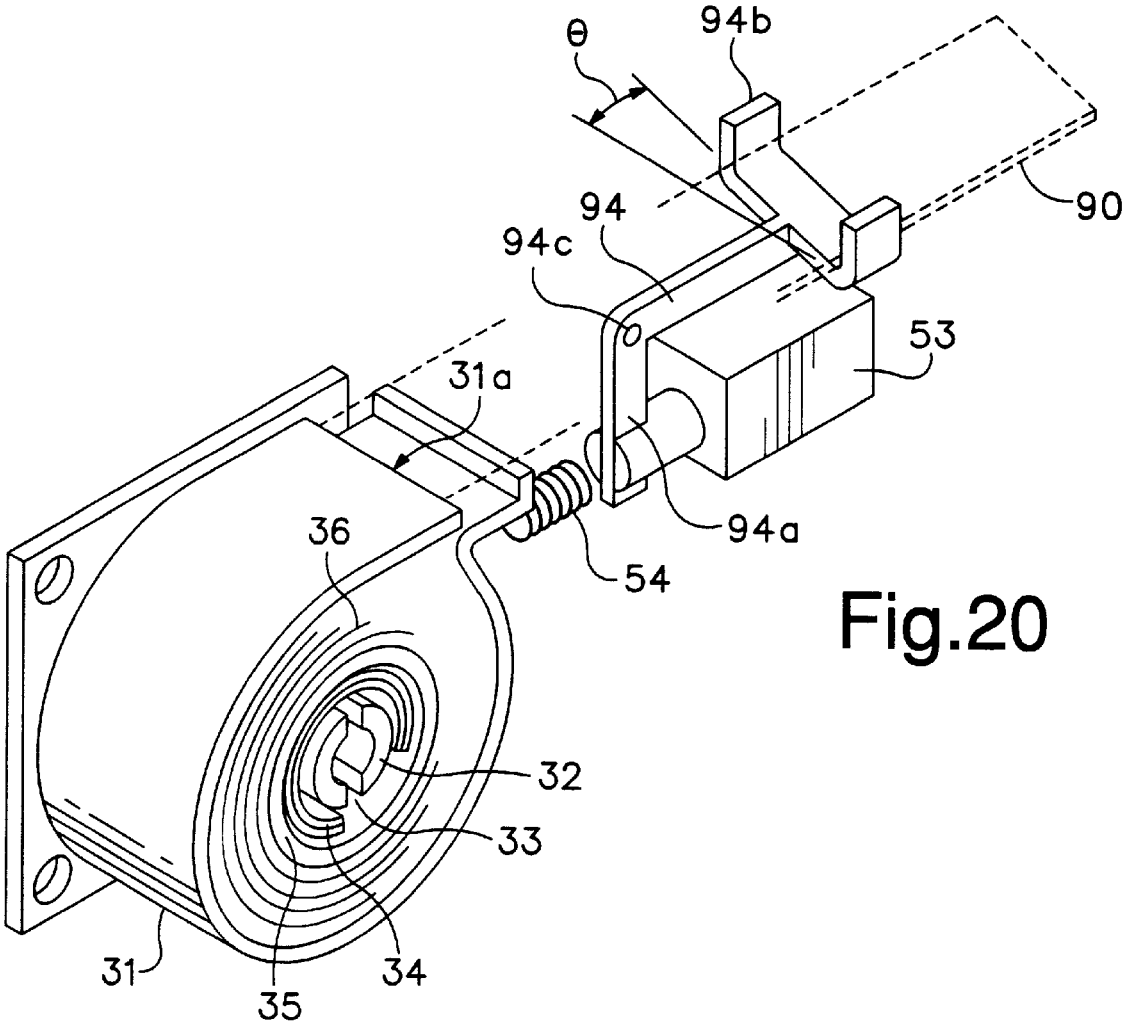
FIG. 20 is a schematic construction view of an internal structure of the extension guide unit shown in FIG. 19.

In order to maintain the above-mentioned predetermined angle $\ominus$, as shown in FIG. 19 and FIG. 20, the belt plate receiver 94*b* of the belt plate elevating lever 94 is inclined by an angle $\ominus$. On the other hand, a bottom 96*a* of the hook aperture 96 of the carriage 17 is also inclined by an angle $\ominus$. Thus, when the hook 92 is hooked on the hook aperture 96, the belt plate 90 is inclined by $\ominus$ in angle by its own weight. Consequently, the both ends of the extension guide 36 are inclined by $\ominus$ in angle in the vicinity of the inlet and outlet 31*a* of the extension guide unit 30 and in the vicinity of the belt plate 90. Further, the portion extending from the inlet and outlet 31*a* of the extension guide 36 is inclined by about $\ominus$ in angle in its entirety by tension of the plate spring 34. In this manner, as mentioned above, the tip of the recording medium 100 conveyed while supported by the drive roller 12 and the sheet conveyance roller 10*b* is very smoothly guided to the extension guide 36, and thereby preventing a jam. Further, in the event that there is provided such an arrangement that after the recording medium 100 reaches the discharge roller 14 and the spur 15 passing through the slot between the print plate 13 and the extension guide 36, and the recording medium 100 is supported by the discharge roller 14 and the spur 15, the extension guide 36 is maintained as it is, and the belt plate elevating mechanism is released to set up the predetermined angle $\ominus$ to 0°, it is possible to ensure the flatness of the recording medium, even if there is a swelling of a recording medium below the extension guide 36, in such a manner that the swelling is pressed and the swelling corresponding is pushed out forward of the discharge roller 14 and the spur 15.

By the way, as mentioned above, according to the plotter 1 (cf. FIG. 1), it is possible to perform a printing on a sheet-like shaped recording paper (a cut sheet), which is inserted from the recording medium insertion inlet 4, and a recording paper (a rolled paper) 6 wound as a roll. However, the plotter 1 cannot determine how the tip of a cut sheet curls. For this reason, the extension guide 36 is extended, before the cut sheet is supported by the drive roller 12 and the sheet conveyance roller 10*b*, on the assumption that the tip of the cut sheet curls upward (up curl) on the print plate. On the other hand, usually, a rolled paper is of a down curl due to the wind peculiarities, and thus advances to the second conveyance roller without any problem. Thus, with respect to the rolled paper, as will be described later, the extension guide 36 is not used, different from the cut sheet, before the cut sheet is supported by the drive roller 12 and the sheet conveyance roller 10*b*.

When the carriage 17 pulls the extension guide 36, the scanning speed of the carriage 17 is decreased. The reason why this is to do so is that if the extension guide 36 is subjected to taking in and out at high speed, the extension guide 36 is bustling (fluttering), and thus this involves such a problem that the extension guide 36 collides with the peripheral parts such as rollers.

Providing that a situation that the scanning speed of the carriage 17 is decreased is denoted by a low speed mode, and a scanning speed involved in the usual printing and the like is denoted by a high speed mode, it is noted for example, that the scanning speed of the carriage 17 is 250 mm/sec in the low speed mode, while the scanning speed of the carriage 17 is 1000 mm/sec in the high speed mode.

The carriage 17 is equipped with a photosensor for detecting a sheet width (both edges of a recording medium with respect to its width direction). The sheet width is detected by reciprocating the carriage 17. When a cut sheet is set up to the plotter 1, the scanning speed is of the low speed mode since the sheet width detection is performed after the extension guide 36 is extended. Hence, if the difference in the scanning speed of the carriage 17 between the high speed mode and the low speed mode is of four times as described above, there is a large difference in a sheet width detection time between the cut sheet and the rolled paper in which the extension guide is set up after a sheet width detection. Consequently, it is very effective from the viewpoint such that the set time is reduced that a timing for extension of the extension guide 36 is varied.

Figure 22:
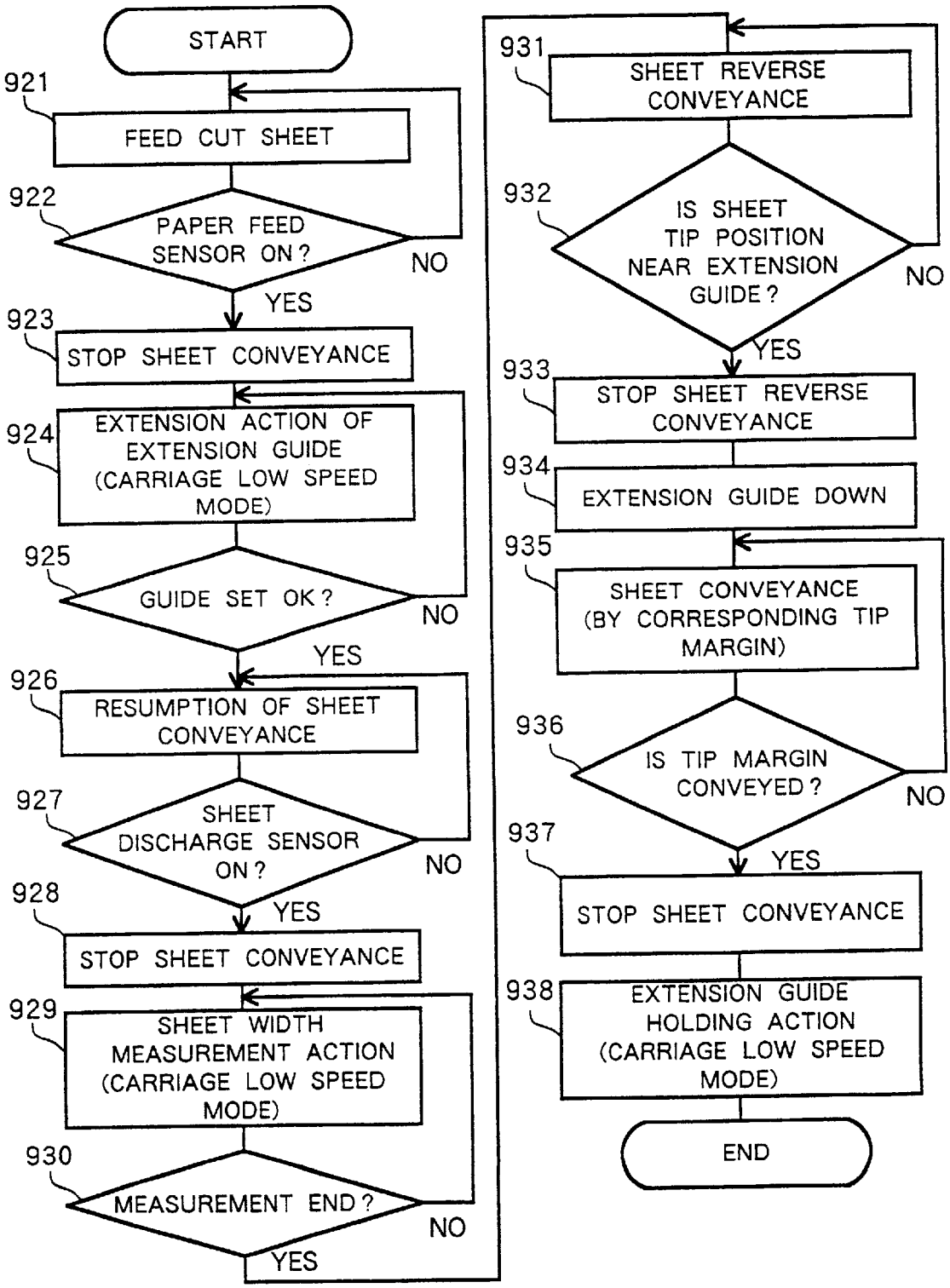
FIG. 22 is a flowchart useful for understanding an operation when the cut sheet is used.

Next, with reference to FIG. 22, there will be explained an action when a cut sheet is used.

When a cut sheet is inserted from the recording medium insertion inlet 4 (cf. FIG. 1), the inserted cut sheet is automatically fed and conveyed (921). When the conveyed cut sheet reaches a sheet feeding sensor 110 (cf. FIG. 21) to incline a sensor flag 112, the sheet feeding sensor 110 turns on (922) to stop the conveyance (923). In this state, the carriage 17 is moved to pull and extend the extension guide 36, so that hook 92 is hooked on the hook aperture 96 (924). Thus, the scanning speed of the carriage 17 is of the low speed mode. Next, the carriage 17 is scanned to extend and set up the extension guide 36 (925). After this set up, the conveyance of the cut sheet is resumed (926). At that time, even if the tip of the cut sheet curls upward, the cut sheet is guided by the extension guide 36, and thus the cut sheet, which is derived from the pair of the sheet conveyance roller 10*b* and the drive roller 12, smoothly reaches the pair of the discharge roller 14 and the spur 15, and then supported by those.

The cut sheet supported by the discharge roller 14 and the spur 15 is further conveyed and reaches the discharge sensor 114 (cf. FIG. 5) to incline the sensor flag 116. When the sensor flag 116 is inclined, the discharge sensor 114 turns on (927) to stop the conveyance (928). Thereafter, a sheet width measurement action is performed to measure a width of the cut sheet (929). At that time, the scanning speed of the carriage 17 is of the low speed mode, since the extension guide 36 is extended. When the measurement of the sheet width is terminated (930), the drive roller 12 is reversely rotated to return the cut sheet (931). Even if the discharge sensor 114 turns off by the return of the cut sheet, the cut sheet is further returned by a certain amount, and when the tip of the cut sheet passes through the discharge roller 14 and the spur 15 and comes near the extension guide 36 (932), the reverse rotation of the drive roller 12 is stopped (933). In this state, the slant of the extension guide 36 is made down to 0° (934), so that the swelling of the cut sheet due to the curl is eliminated. Next, there is provide such a control that the tip margin amount becomes a set up value (935). The cut sheet is conveyed by an amount in which the tip margin amount becomes a set up value (936). If the tip margin amount becomes a usual set up value, it means that the tip of the cut sheet is supported by the discharge roller 14 and the spur 15. In the event that the cut sheet is conveyed by the amount in which the tip margin amount becomes a set up value, the cut sheet is stopped in its conveyance (937). Thereafter, the carriage 17 causes the extension guide 36 to be held in the extension guide holder 31 (938), and the set up of the cut sheet is completed.

Figure 23:
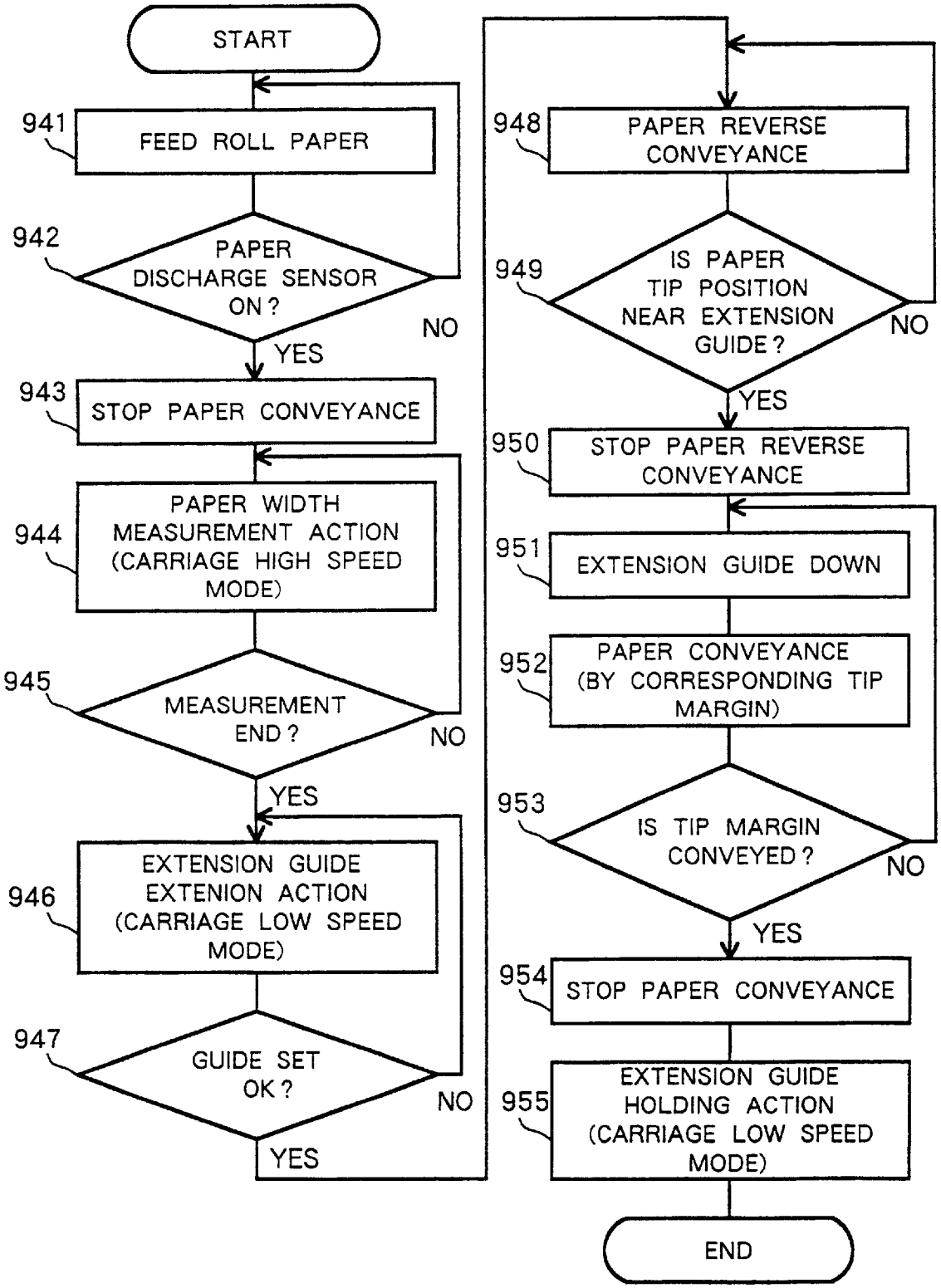
FIG. 23 is a flowchart useful for understanding an operation when the rolled sheet is used.

Next, with reference to FIG. 23, there will be explained an action in which a rolled paper is used.

As mentioned above, usually, the tip of a rolled paper offers a down curl because of getting into a peculiarity of winding, and is smoothly supported by the discharge roller 14 and the spur 15. Accordingly, the extension guide 36 is not used before the rolled paper is supported by the sheet conveyance roller 10*b* and the drive roller 12. When a rolled paper is inserted from the recording medium insertion inlet 4 (cf. FIG. 1), the inserted rolled paper is automatically fed and conveyed (941). When the rolled paper reaches the discharge roller 14 and the spur 15 and is supported by those, and then further conveyed and reaches a sheet discharge sensor 114 (cf. FIG. 21) to incline a sensor flag 116, the sheet discharge sensor 114 turns on (942) to stop the conveyance (943). Thereafter, width of the rolled paper is measured (944). In this case, since the extension guide 36 is not drawn out, the paper width measurement is performed in the above-mentioned high speed mode. When it is determined that the paper width measurement is completed (945), as mentioned above, the carriage 17 causes the extension guide 36 to be drawn out from the extension guide holder 31 and be expanded (946). When it is decided that the extension guide 36 is extended (947), the drive roller 12 is reversely rotated to return the rolled sheet (948).

Even if the discharge sensor 114 turns off by the return of the rolled paper, the rolled paper further returned by a certain amount, and when the tip of the rolled paper passes through the discharge roller 14 and the spur 15 and comes near the extension guide 36 (949), the reverse rotation of the drive roller 12 is stopped (950). In this state, the slant of the extension guide 36 is made down to 0° (951), so that the swelling of the cut sheet due to the curl is eliminated. Next, the rolled paper is conveyed in such manner that the tip margin amount becomes a set up value (952). The rolled paper is conveyed by an amount in which the tip margin amount becomes a set up value (953). If the tip margin amount becomes a usual set up value, it means that the tip of the rolled paper is supported by the discharge roller 14 and the spur 15. In the event that the rolled paper is conveyed by the amount in which the tip margin amount becomes a set up value, the rolled paper is stopped in its conveyance (954). Thereafter, the carriage 17 causes the extension guide 36 to be held in the extension guide holder 31 (955), and the set up of the rolled paper is completed.

Next, with reference to FIG. 24, there will be described behavior of the plate spring 34 in the event that the extension guide 36 is drawn out from the extension guide holder 31 and also in the event that the extension guide 36 is held in the extension guide holder 31.

As mentioned above, the extension guide 36 is wound around the drum 35, and one end of the extension guide 36 is fixed on the coupling portion 35*a*. One end of the plate spring 34 is inserted into the center shaft 32 and fixed thereon. The plate spring 34 is in contact with the inner wall of the drum 35 in the state that it is before the spring force is released, and is wound around the center shaft 32. Another end of the plate spring 34 is fixed on the coupling portion 35*a*.

Figure 24:
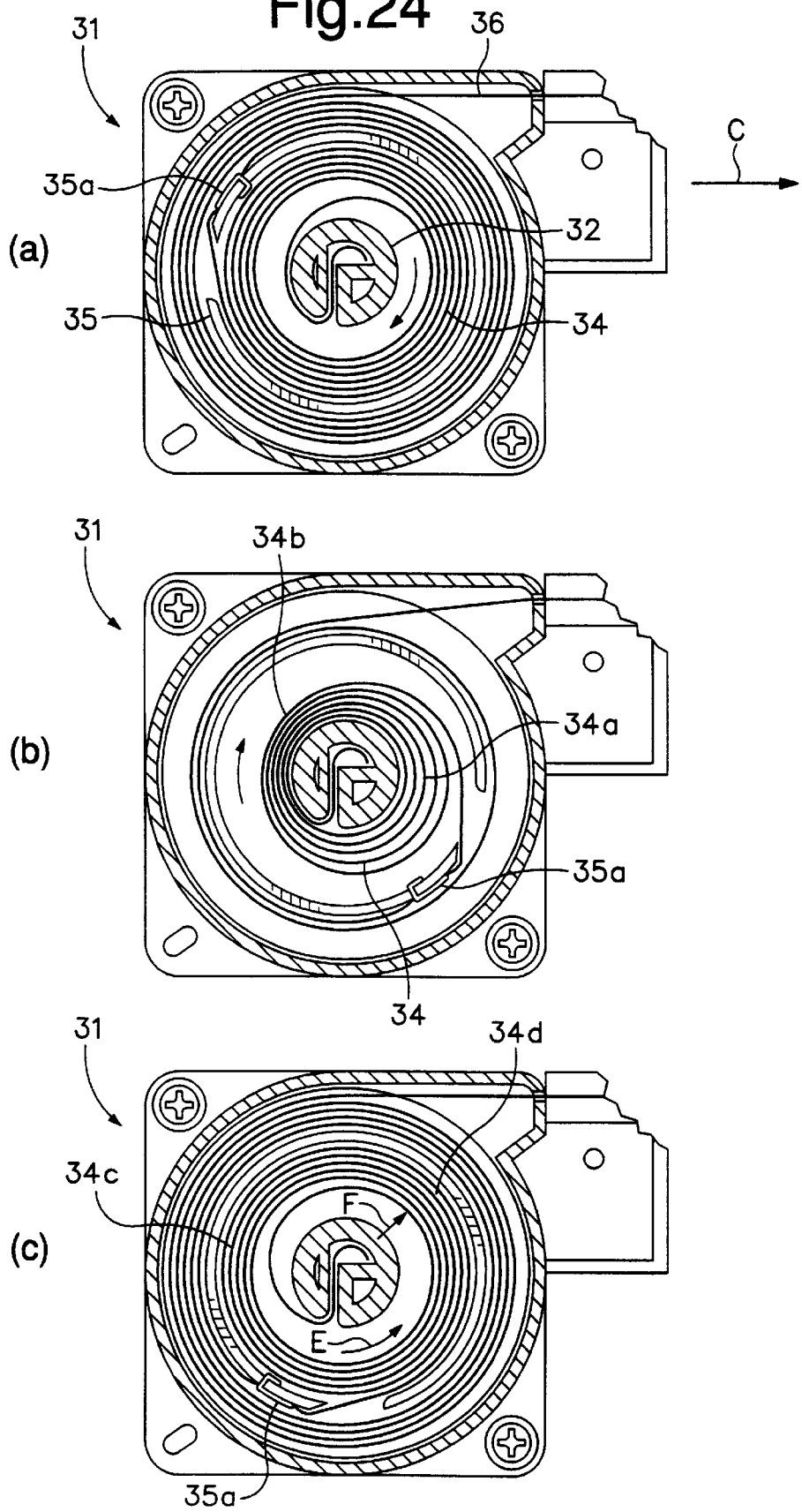
FIG. 24 is a typical illustration useful for understanding behavior of a plate spring to accompany a movement of the extension guide, part (*a*) of FIG. 24 showing a state in which the extension guide is accommodated in an extension guide holder, part (*b*) of FIG. 24 showing a state in which the extension guide has been substantially completely drawn out from the extension guide holder, and part (*c*) of FIG. 24 showing a state in which the extension guide is being accommodated in the extension guide holder.

As the extension guide 36 is drawn out in the arrow C direction, as shown in FIG. 24(*b*), the drum 35 rotates and the plate spring 34 is wound, so that the diameter of the plate spring 34 gradually becomes small and the plate spring 34 lies on the peripheral surface of the center shaft 32. In this manner, when the extension guide 36 is drawn out in the arrow C direction, there are formed a roughly overlapping portion 34*a* and a closely overlapping portion 34*b* on an overlapping portion of the plate spring 34 in accordance with a positional relation between the portion of the plate spring 34 fixed on the center shaft 32 and the portion of the plate spring 34 fixed on the coupling portion 35*a*. These portions 34*a* and 34*b* are rotated and varied per se. In other words, as the extension guide 36 is drawn out in the arrow C direction, the plate spring 34 rotates eccentrically to gradually become small in its diameter.

When tension of the extension guide 36 is weakened, the spring force accumulated in the plate spring 34 is released and the drum 35 rotates in the arrow E direction, so that the extension guide 36 is wound to be held in the extension guide holder 31. When the spring force of the plate spring 34 is released, the plate spring 34 is gradually spread toward the inner wall of the drum 35. When the plate spring 34 is spread, in a similar fashion to that of the diameter of the plate spring 34 gradually becoming small, there are formed a roughly overlapping portion 34*c* and a closely overlapping portion 34*d* on the overlapping portion of the plate spring 34, and the plate spring 34 rotates eccentrically to be spread. In this case, when the plate spring 34 is released, different from a case where it is wound, the positions of the roughly overlapping portion and the closely overlapping portion are not rotated and constant. The reason why this is to do so is that as shown in FIG. 24(*c*), spring force acts in the arrow F direction on a portion of the plate spring 34 in which the curvature of the plate spring 34 derived from the center shaft 32 becomes large. This spring force causes a portion 34*d* closely overlapping with the plate spring 34 to be formed, so that the plate spring involved in this portion is urged toward the inner wall of the drum 35. As a result, a sliding resistance to prevent the rotation of the drum 35 will occur and the drum 35 is hard to rotate in the arrow E direction. Thus, there is a possibility of an occurrence of such a trouble that it is hard to rewind the extension guide 36.

Figure 25:
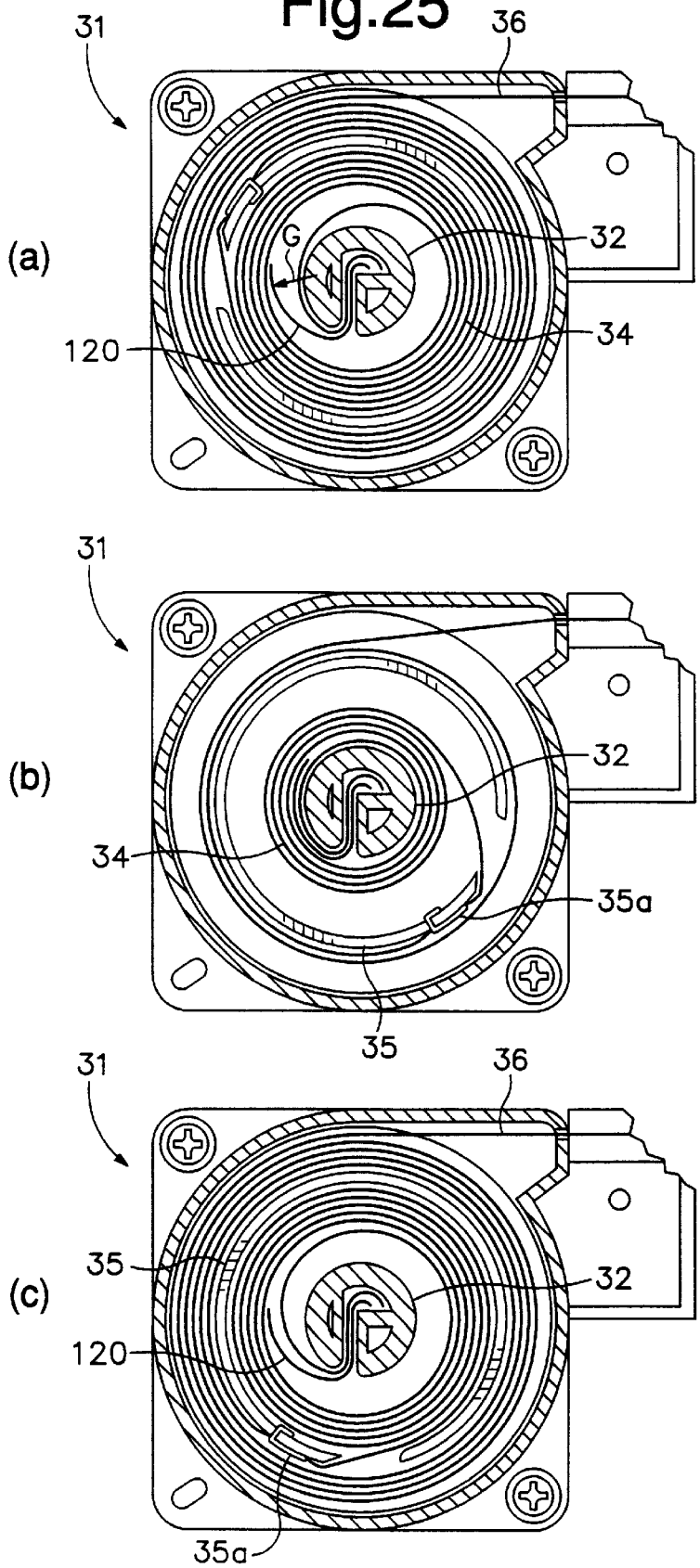
FIG. 25 is a typical illustration useful for understanding behavior of a plate spring and an auxiliary spring to accompany a movement of the extension guide, part (*a*) of FIG. 25 showing a state in which the extension guide is accommodated in an extension guide holder, part (*b*) of FIG. 25 showing a state in which the extension guide has been substantially completely drawn out from the extension guide holder, and part (*c*) of FIG. 25 showing a state in which the extension guide is being accommodated in the extension guide holder.

With reference to FIG. 25, there will be explained technology to solve the above-mentioned trouble.

As shown in FIG. 25(*a*), an auxiliary spring 120, one end of which is fixed on the center shaft 32, is disposed in such a manner that the short plate spring 120 is in contact with the inside of the plate spring 34. The auxiliary plate spring 120 presses a contact portion with the plate spring 34 in the arrow G direction. As will be described later, this arrangement makes it possible to solve the trouble involved in the event that the plate spring 34 is released. The auxiliary spring 120 presses the roughly overlapping portion 34*c* (cf. FIG. 24(*c*)) of the plate spring 34, and thus as shown in FIG. 25(*c*), there is no distinction between the closely overlapping portion and the roughly overlapping portion of the plate spring 34. As a result, the overlapping of the plate spring 34 is unified. Accordingly, it is possible to solve the trouble such that the drum 35 is hard to rotate in the arrow E direction owing to the closely overlapping portion 34*d* of the plate spring 34 as mentioned above and thus it is hard to rewind the extension guide 36.

In this manner, the use of the auxiliary spring 120 makes it possible to reduce the unevenness of the overlapping portion of the plate spring 34 in rough and closeness and whereby the drum 35 smoothly rotates. Thus, the sliding resistance between the drum 35 and the plate spring 34 is reduced and as a result an emanating sound, which will be generated when the plate spring 34 spreads, is reduced.

Figure 26:
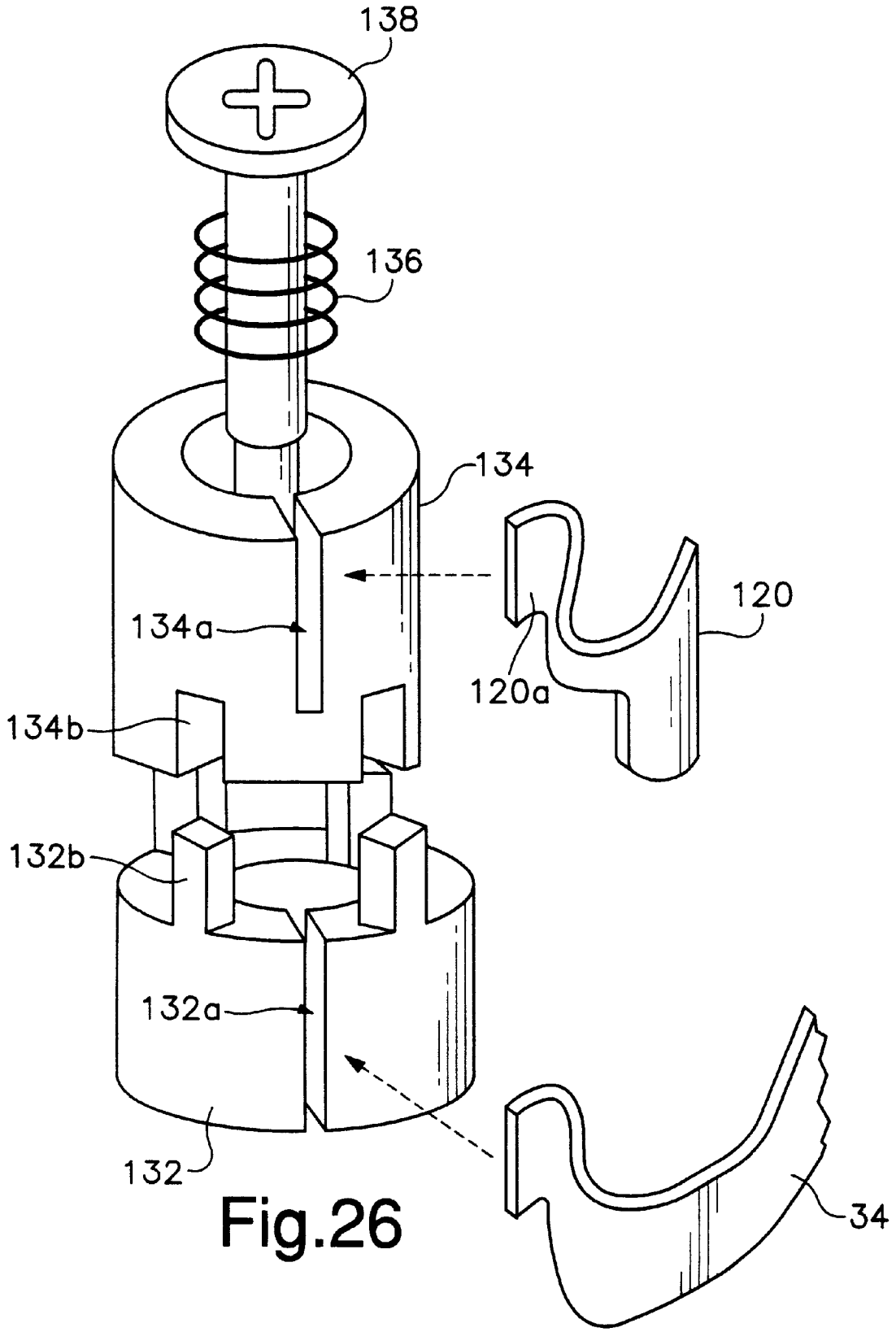
FIG. 26 is an exploded perspective view of an alternative example of the center shaft.
Figure 27:
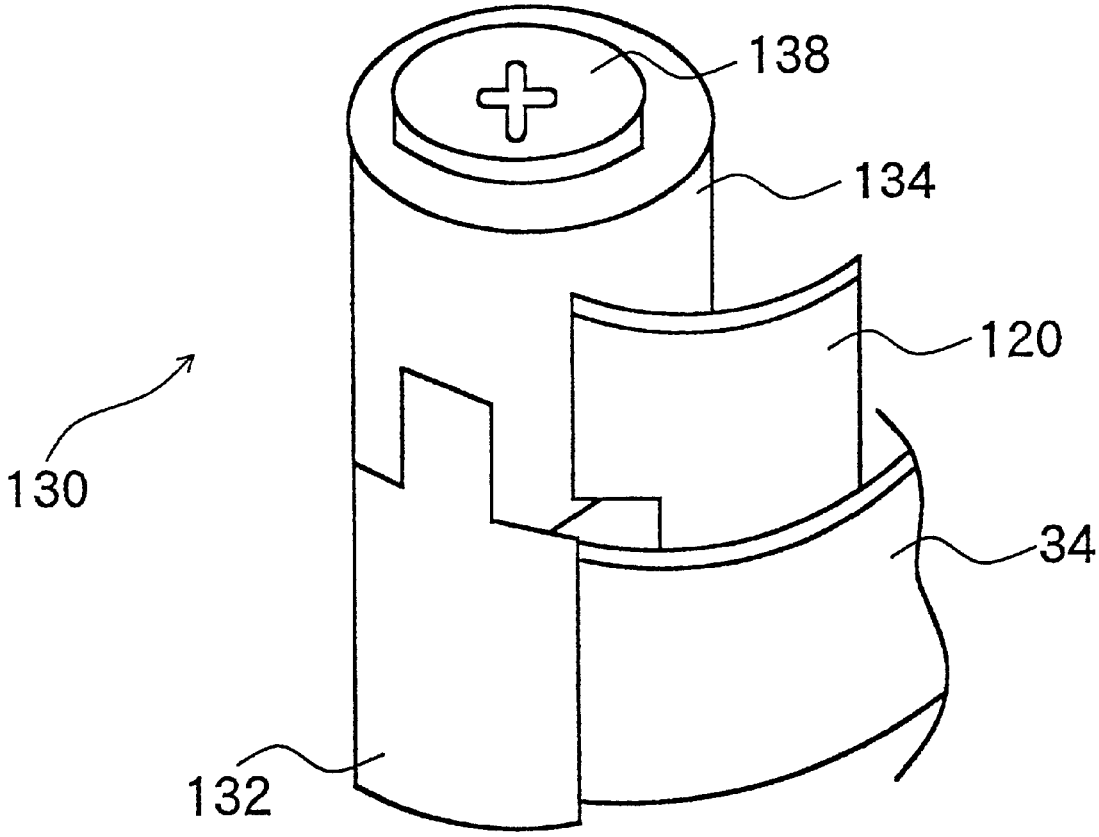
FIG. 27 is a perspective view of an assembly in the state that the center shaft shown in FIG. 26 is assembled.

Next, with reference to FIGS. 26 and 27, there will be described an alternative embodiment of the center shaft 32 fixed on the extension guide holder 31.

A center shaft 130 comprises a first center shaft 132 and a second center shaft 134 which are fixed on one another. A screw 138, which penetrates a compression coil spring 136, is inserted into the second center shaft 134. A fixing portion 134*a* for fixing the auxiliary spring 120 is formed on the second center shaft 134. On the other hand, a fixing portion 132*a* for fixing the plate spring 34 is formed on the first center shaft 132. When the first center shaft 132 and the second center shaft 134 are fixed on one another, for example, the second center shaft 134 is rotated to change their respective engagement portions 132*b* and 134*b*. This enables the fixing portion 134*a* for fixing a one end 120*a* of the auxiliary spring 120 to vary in its position. Since the second center shaft 134 is enabled by the compression coil spring 136, the auxiliary spring 120 is surely fixed. This arrangement makes it possible to readily alter the pressing position in which the auxiliary spring 120 presses the plate spring 34. Consequently, when the extension guide units 30, 60 and 80 are assembled, even if there exists various types of extension guides in its length according to the specification (paper sizes to be used), and a winding number of the plate spring 34 and thickness of the plate spring 34 are varied and as a result the position of the roughly overlapping portion is altered, it is possible to surely press this portion.

Next, with reference to FIG. 28, there will be explained four auxiliary springs 120 which are fixed on the center shaft 32.

Figure 28:
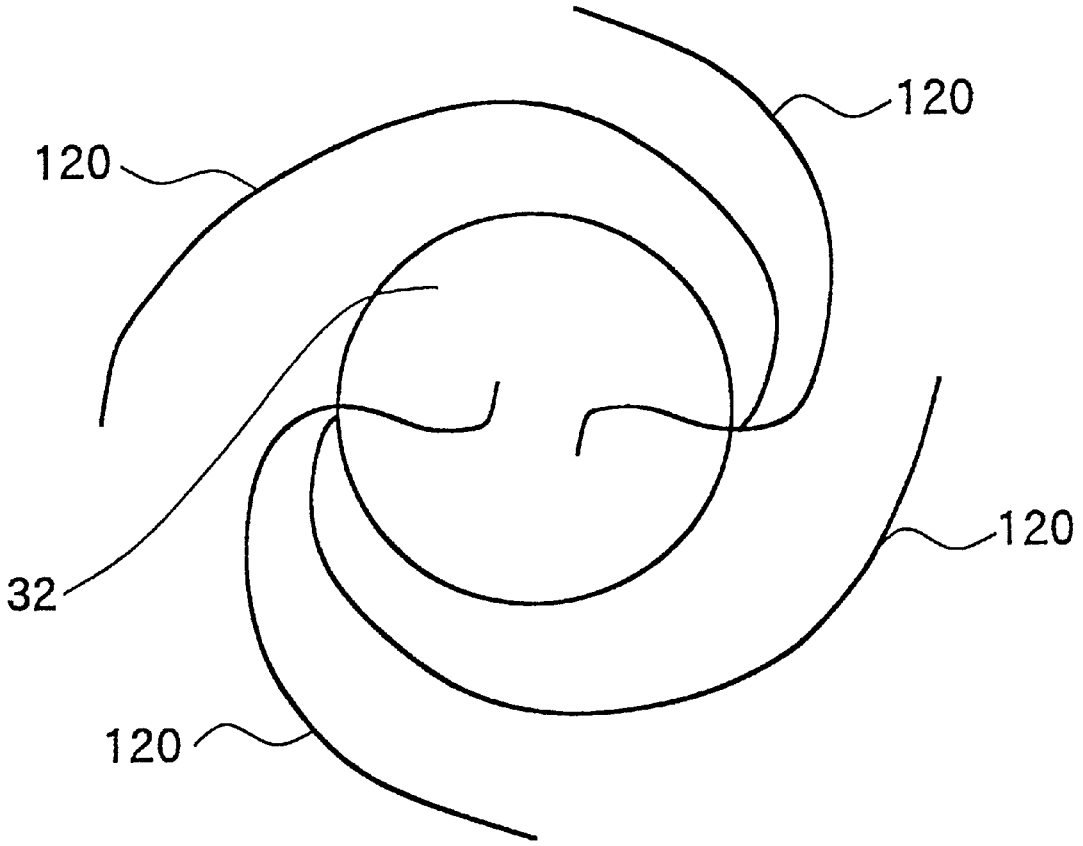
FIG. 28 is a typical top view of the center shaft in which four auxiliary springs are fixed.

As shown in FIG. 28, four auxiliary springs 120 are fixed on the center shaft 32 in such a manner that pressing positions for pressing the plate spring 34 by the respective auxiliary springs 120 are mutually differentiated. This arrangement makes it possible to press the roughly winding portion by any one of a plurality of auxiliary springs 120, even if the position of the roughly winding portion of the plate spring 34 is varied when the extension guide 36 is subjected to taking in and out. As a result, rough and closeness of the overlapping portion of the plate spring 34 is more reduced, so that the drum 35 (cf. FIG. 20) and the plate spring 34 are smoothly rotated and whereby the extension guide 36 may be subjected to taking in and out. It is acceptable that spring pressure of four auxiliary springs 120 is set up with the same value, alternatively, it is also acceptable that spring pressure of the auxiliary springs, which press the roughly overlapping portion of the plate spring 34 when the extension guide 36 is held, is emphasized. Incidentally, it is noted that the extension guide holder 31 is applicable as not only the guide unit of the above-mentioned image forming apparatus employing an ink jet system, but also apparatuses for drawing out or rewinding electric wires, hoses and the like.

INDUSTRIAL APPLICABILITY

As explained above, according to the first recording medium conveying apparatus of the present invention, a recording medium conveyed by the first conveyance roller is guided by the extension guide and conveyed to the second conveyance roller. This feature makes it possible to smoothly convey the recording medium. An extension guide holder is disposed at the side of the recording medium conveying passage. The extension guide is held by the extension guide holder. Thus, it is possible to smoothly convey the recording medium with a simple structure.

Here, in the event that there is provided a scanning member for scanning in an intersection direction and the extension guide is retractively extended in the intersection direction following the scanning of the scanning member, the extension guide is readily extended.

Further, in the event that an extension sheet clamp is used instead of the extension guide, it is possible to form a high-definition of image on a recording medium.

According to the second recording medium conveying apparatus of the present invention, the use of the extension guide makes it not only possible to preferably convey a recording medium, but also possible to use the suitable extension guide in accordance with the type of the recording medium to be used.

According to the third recording medium conveying apparatus of the present invention, when the tip of the rolled paper enters the second conveyance roller, the extension guide control means is used to control the extension guide so as to guide the rolled paper. Thus, it is possible to preferably convey the rolled paper.

According to the fourth recording medium conveying apparatus of the present invention, a recording medium is conveyed by a strip-shaped extension guide which is inclined by a predetermined angle in such a manner that an interval between the upward stream side portion with respect to the conveyance direction and the print plate is broader than an interval between the downward stream side portion with respect to the conveyance direction and the print plate. This feature makes it possible to more smoothly convey the recording medium.

Here, in the event that incline means for inclining the extension guide by a predetermined angle is provided on at least one of the coupling portion of the scanning member with the extension guide and the neighbor portion of the inlet and outlet of the extension guide holder, it is possible to incline the extension guide by a predetermined angle with a simple structure.

Further, in the event that the incline means releases incline of the predetermined angle of the extension guide after the recording medium is supported by the first conveyance roller and the second conveyance roller, it is possible to suppress swelling on the portion between the print plate and the extension guide, of the recording medium, and the neighbor portion, thereby ensuring flatness of the recording medium.

Furthermore, in the event that the extension guide holder has a ring member, an auxiliary spring and the like, the roughly wound portion of the plate spring is pressed by an one end of the auxiliary spring from the inside of the plate spring. Thus, rough and closeness of the overlapping portion of the plate spring is reduced, and as a result the plate spring smoothly rotates together with the ring member thereby smoothly taking the extension unit in and out.

Still further, in the event that the center shaft of the holder container enables the fixing position for fixing one end of the auxiliary spring to alter and the auxiliary spring alters the pressing position for pressing the plate spring in accordance with an alteration of the fixing position, when the holder is assembled, even if a number of windings of the plate spring and thickness of the plate spring are varied and as a result a position of the roughly overlapping portion is changed, it is possible to surely press this portion.

Still furthermore, in the event that a plurality of auxiliary springs are fixed on the center shaft and the pressing positions for pressing the plate spring are mutually differentiated, when the extension unit is take in and out, even if a position of the roughly wound portion of the plate spring is moved, any one of the plurality of auxiliary springs can press the roughly wound portion. Thus, rough and closeness of the overlapping portion of the plate spring is further reduced so that plate spring smoothly rotates together with the ring member thereby smoothly taking the extension unit in and out.

What is claimed is:

1. A recording medium conveying apparatus of an image forming apparatus having a first conveyance roller for conveying a recording medium and a second conveyance roller for conveying further the recording medium discharged from the first conveyance roller, for forming an image on the recording medium between the first conveyance roller and the second conveyance roller, said recording medium conveying apparatus comprising:

an extension guide for guiding the recording medium discharged from the first conveyance roller toward the second conveyance roller, the extension guide being provided to be retractively extendable from a lateral side of a recording medium conveying passage in a direction intersecting the recording medium conveying passage between the first conveyance roller and the second conveyance roller; and an extension guide holder for encasing said extension guide, said extension guide holder being disposed at a lateral side of the recording medium conveying passage.

2. A recording medium conveying apparatus according to claim 1 further comprising a scanning member for scanning in the intersection direction between the first conveyance roller and the second conveyance roller in the intersection direction, wherein said extension guide is coupled with said scanning member and is retractively extendable in the intersection direction following scanning of said scanning member.

3. A recording medium conveying apparatus according to claim 2, wherein said apparatus further comprises a coupling unit for coupling said extension guide with said scanning member.

4. A recording medium conveying apparatus according to claim 1, wherein said extension guide is replaced by an extension sheet clamp for clamping the recording medium discharged from the first conveyance roller, said extension sheet clamp being retractively extendable from the side of the recording medium conveying passage in the intersection direction between the first conveyance roller and the second conveyance roller, and wherein said extension guide holder holds said extension sheet clamp.

5. A recording medium conveying apparatus for an image forming apparatus having a first conveyance roller for conveying a recording medium, and a second conveyance roller for conveying the recording medium discharged from the first conveyance roller, in which an image is formed on the recording medium between the first conveyance roller and the second conveyance roller, said recording medium conveying apparatus comprising:

an extension sheet clamp for clamping the recording medium discharged from the first conveyance roller, said extension sheet clamp being retractively extendible from the side of the recording medium conveying passage in the intersection direction between the first conveyance roller and the second conveyance roller;

an extension guide holder for holding said extension sheet clamp, said extension guide holder being disposed at the side of the recording medium conveying passage; and a holding unit for holding said extension sheet clamp extended, said holding unit being disposed at a side of the recording medium conveying passage, said side being opposite to the side in which said extension guide holder is disposed.

6. A recording medium conveying apparatus for an image forming apparatus having a first conveyance roller for conveying a recording medium, and a second conveyance roller for conveying the recording medium discharged from the first conveyance roller, in which an image is formed on the recording medium between the first conveyance roller and the second conveyance roller, said recording medium conveying apparatus comprising:

extension guide means for providing a temporal conveyance guide for a recording medium by extending a strip-shaped extension guide which is retractively extendable from a side of a recording medium conveying passage in a direction perpendicularly intersecting a recording medium conveying direction between the first conveyance roller and the second conveyance roller;

recording medium type selection means for selecting a type of the recording medium to be used; and extension guide control means for controlling a timing of utilization of said extension guide in accordance with the type of the recording medium selected by said recording medium type selection means.

7. A recording medium conveying apparatus according to claim 6, wherein the type of the recording medium is a rolled paper or a cut sheet.

8. A recording medium conveying apparatus according to claim 7, wherein, when the recording medium is a cut sheet, said extension guide control means extends the extension guide before discharge of the front end portion of the cut sheet from the first conveyance roller; or, when the recording medium is a rolled paper sheet, said extension guide control means extends the extension guide after passing of the front end of the rolled paper sheet through the second conveyance roller and cutting of a portion of the front end of the rolled paper sheet by a cutter provided at the discharge side of the second conveyance roller, draws back the cut front end of the rolled paper sheet outside the second conveyance roller, and conveys the cut front end again through the second conveyance roller; and thereafter, in regardless of whether the recording medium is a cut sheet paper or a rolled paper sheet, the extension guide control means retracts the extension guide before the image formation.

9. A recording medium conveying apparatus according to claim 6, wherein said apparatus further comprises extension suppression means for suppressing an extension action of said extension guide.

10. A recording medium conveying apparatus according to claim 9, wherein said extension suppression means suppresses an extension action of said extension guide in accordance with an instruction of a user.

11. A recording medium conveying apparatus according to claim 9, wherein said extension suppression means comprises:

roll paper residual quantity detection means for detecting that a residual quantity of rolled paper is less than a predetermined quantity; and means for suppressing an extension of said extension guide until said roll paper residual quantity detection means detects that a residual quantity of rolled paper is less than the predetermined quantity.

12. A recording medium conveying apparatus of an image forming apparatus having a first conveyance roller for conveying a roll paper sheet as a recording medium and a second conveyance roller for conveying further the recording medium discharged from the first conveyance roller, for forming an image on the recording medium between the first conveyance roller and the second conveyance roller, said recording medium conveying apparatus comprising:

an extension guide means which provides a temporary conveyance guide for the recording medium by employing a strip-shaped extension guide extendible retractively from a lateral side of a recording medium conveying passage in a direction perpendicularly intersecting the recording medium conveying passage between the first conveyance roller and the second conveyance roller; and an extension guide control means which extends the extension guide after passing the front end of the rolled paper sheet through the second conveyance roller, and retracts the rolled paper sheet after cutting of a portion of the front end by a cutter provided at the discharge side of the second conveyance roller, bringing back the cut front end of the rolled paper sheet outside the second conveyance roller, and passing again the cut front end through the second conveyance roller, but before the image formation.

13. A recording medium conveying apparatus for an image forming apparatus having a first conveyance roller for conveying a rolled paper as a recording medium, and a second conveyance roller for conveying the recording medium discharged from the first conveyance roller, in which an image is formed on the recording medium between the first conveyance roller and the second conveyance roller, said recording medium conveying apparatus comprising:

an extension guide means for providing a temporal conveyance guide for a recording medium by extending a strip-shaped extension guide which is retractively extendible from a side of a recording medium conveying passage in a direction perpendicularly intersecting a recording medium conveying direction between the first conveyance roller and the second conveyance roller;

an extension guide control means for extending said extension guide means after the rolled paper is cut off at a position through which the rolled paper passes, such that a tip of a new rolled paper returns to passing through the second conveyance roller and again enters the second conveyance roller, and said extension guide goes back before an image formation; and an extension suppression means for suppressing an extension action of said extension guide.

14. A recording medium conveying apparatus according to claim 13, wherein said extension suppression means suppresses an extension action of said extension guide in accordance with an instruction of a user.

15. A recording medium conveying apparatus according to claim 13, wherein said extension suppression means comprises:

roll paper residual quantity detection means for detecting that a residual quantity of rolled paper is less than a predetermined quantity; and means for suppressing an extension of said extension guide until said roll paper residual quantity detection means detects that a residual quantity of rolled paper is less than the predetermined quantity.

16. A recording medium conveying apparatus of an image forming apparatus, the recording medium conveying apparatus having a firs conveyance roller for conveying a recording medium and a second conveyance roller for conveying further the recording medium discharged from the first conveyance roller, and the image forming apparatus having a print plate extending in a direction perpendicularly intersecting the recording medium conveying direction for conveying a recording medium on the one face of the print plate for formation of an image on the one face of the print plate between the first conveyance roller and the second conveyance roller, said recording medium conveying apparatus comprising:

a scanning member for scanning the recording medium in the direction perpendicular to the recording medium conveying direction on the side reverse to the print plate;

a strip-shaped extension guide inclined at a predetermined angle to make the interval between the extension guide and the print plate larger at the upstream -side of the delivery direction than the downstream side thereof, and connected detachably to the scanning member to extend in the intersecting direction over the reverse face side; and an extension guide holder for encasing extendably the extension guide in a wound state disposed at one end side of the print plate in the length direction thereof.

17. A recording medium conveying apparatus according to claim 16, wherein incline means for inclining said extension guide by a predetermined angle is provided on at least one of a coupling portion of said scanning member with said extension guide and a neighbor portion of the inlet and outlet of said extension guide holder.

18. A recording medium conveying apparatus according to claim 17, wherein said incline means releases incline of the predetermined angle of said extension guide after the recording medium is supported by at least one of said first conveyance roller and said second conveyance roller.

19. In an image forming apparatus having a print plate on a one side of which a recording medium is conveyed, said print plate being extended in an intersection direction intersecting a recording medium conveying direction, wherein an image is formed on a portion located at said one side of said print plate, of the recording medium, a recording medium conveying apparatus having a first conveyance roller for supporting and conveying the recording medium in the recording medium conveying direction, and a second conveyance roller for supporting and conveying the recording medium discharged from the first conveyance roller, said first conveyance roller and said second conveyance roller being disposed at an upward stream side and a downward stream side with respect to the recording medium conveying direction across said print plate from one another, respectively, said recording medium conveying apparatus comprising:

a scanning member for scanning an opposite side to said print plate across the portion located at said one side of said print plate, of the recording medium, in the intersection direction;

a strip-shaped extension guide inclined by a predetermined angle in such a manner that an interval between the upward stream side portion with respect to the recording medium conveyance direction and the print plate is broader than an interval between the downward stream side portion with respect to the recording medium conveyance direction and the print plate, said extension guide being detachably coupled with said scanning member and being retractive in the intersection direction on said opposite side; and an extension guide holder having an inlet and outlet for said extension guide, said extension guide holder being adapted to hold said extension guide in a wound state on a freedom basis in taking in and out, and being disposed at a one side of said print plate in its longitudinal direction, wherein said extension guide holder comprises:

a holder container having a predetermined inlet and outlet formed on a side wall, and a center shaft extending from a center of a bottom wall in a vertical direction;

a plate spring, a one end of which is fixed on said center shaft, wound around said center shaft;

a ring member surrounding a periphery of said plate spring, another end of said plate spring being fixed on said ring member;

an extension member, a one end of which is fixed on said ring member, wound around said ring member and another end of which is drawn out through said predetermined inlet and outlet to be extended; and an auxiliary spring, a one end of which is fixed on said center shaft, for pressing a roughly wound portion of said plate spring by another end of the auxiliary spring from inside of said plate spring.

20. A recording medium conveying apparatus according to claim 19, wherein the center shaft of said holder container enables a fixing position for fixing said one end of said auxiliary spring to alter, and said auxiliary spring alters a pressing position for pressing said plate spring in accordance with an alteration of the fixing position.

21. A recording medium conveying apparatus according to claim 19, wherein a plurality of said auxiliary springs are fixed on the center shaft and pressing positions for pressing said plate spring are mutually differentiated.

22. A recording medium conveying apparatus according to claim 2, wherein said extension guide is replaced by an extension sheet clamp for clamping the recording medium discharged from the first conveyance roller, said extension sheet clamp being retractively extendable from the side of the recording medium conveying passage in the intersection direction between the first conveyance roller and the second conveyance roller, and wherein said extension guide holder holds said extension sheet clamp.

23. A recording medium conveying apparatus according to claim 3, wherein said extension guide is replaced by an extension sheet clamp for clamping the recording medium discharged from the first conveyance roller, said extension sheet clamp being retractively extendable from the side of the recording medium conveying passage in the intersection direction between the first conveyance roller and the second conveyance roller, and wherein said extension guide holder holds said extension sheet clamp.

24. A recording medium conveying apparatus for an image forming apparatus having a first conveyance roller for conveying a recording medium, and a second conveyance roller for conveying the recording medium discharged from the first conveyance roller, in which an image is formed on the recording medium between the first conveyance roller and the second conveyance roller, said recording medium conveying apparatus comprising:

an extension sheet clamp for clamping the recording medium discharged from the first conveyance roller, said extension sheet clamp being retractively extendible from the side of the recording medium conveying passage in the intersection direction between the first conveyance roller and the second conveyance roller;

a scanning member for scanning in the intersection direction between the first conveyance roller and the second conveyance roller in the intersection direction; and a holding unit for holding said extension sheet clamp extended, said holding unit being disposed at a side of the recording medium conveying passage, said side being opposite to the side in which said extension guide holder is disposed, wherein said extension guide holder holds said extension sheet clamp and is disposed at the side of the recording medium conveying passage, and wherein said extension sheet clamp is coupled with said scanning member and is retroactively extendible in the intersection direction following scanning of said scanning member.

25. A recording medium conveying apparatus for an image forming apparatus having a first conveyance roller for conveying a recording medium, and a second conveyance roller for conveying the recording medium discharged from the first conveyance roller, in which an image is formed on the recording medium between the first conveyance roller and the second conveyance roller, said recording medium conveying apparatus comprising:

an extension sheet clamp for clamping the recording medium discharged from the first conveyance roller, said extension sheet clamp being retractively extendible from the side of the recording medium conveying passage in the intersection direction between the first conveyance roller and the second conveyance roller;

an extension guide holder for holding said extension sheet clamp, said extension guide holder being disposed at the side of the recording medium conveying passage;

a scanning member for scanning in the intersection direction between the first conveyance roller and the second conveyance roller in the intersection direction;

a coupling unit for coupling said extension sheet clamp with said scanning member; and a holding unit for holding said extension sheet clamp extended, said holding unit being disposed at a side of the recording medium conveying passage, said side being opposite to the side in which said extension guide holder is disposed, wherein said extension sheet clamp is coupled with said scanning member and is retroactively extendible in the intersection direction following scanning of said scanning member, and wherein said extension guide holder holds said extension sheet clamp.

26. A recording medium conveying apparatus according to claim 7, wherein said apparatus further comprises extension suppression means for suppressing an extension action of said extension guide.

27. A recording medium conveying apparatus according to claim 8, wherein said apparatus further comprises extension suppression means for suppressing an extension action of said extension guide.

28. A recording medium conveying apparatus according to claim 26, wherein said extension suppression means suppresses an extension action of said extension guide in accordance with an instruction of a user.

29. A recording medium conveying apparatus according to claim 27, wherein said extension suppression means suppresses an extension action of said extension guide in accordance with an instruction of a user.

30. A recording medium conveying apparatus according to claim 26, wherein said extension suppression means comprises:

roll paper residual quantity detection means for detecting that a residual quantity of rolled paper is less than a predetermined quantity; and means for suppressing an extension of said guide until said roll paper residual quantity detection means detects that a residual quantity of rolled paper is less than the predetermined quantity.

31. A recording medium conveying apparatus according to claim 27, wherein said extension suppression means comprises:

roll paper residual quantity detection means for detecting that a residual quantity of rolled paper is less than a predetermined quantity; and means for suppressing an extension of said guide until said roll paper residual quantity detection means detects that a residual quantity of rolled paper is less than the predetermined quantity.

32. A recording medium conveying apparatus according to claim 20, wherein a plurality of said auxiliary springs are fixed on the center shaft and pressing positions for pressing said plate spring are mutually differentiated.

* * * * *